US007165554B2

(12) United States Patent
Fukuyama

(10) Patent No.: US 7,165,554 B2
(45) **Date of Patent: *Jan. 23, 2007**

(54) AUTOMATIC HAIR IMPLANTER FOR MANUFACTURING WIG AND METHOD OF MANUFACTURING WIG

(75) Inventor: Kohki Fukuyama, Tokyo (JP)

(73) Assignee: Propia Co., Ltd., Tokyo (JP)

( * ) Notice: Subject to any disclaimer, the term of this patent is extended or adjusted under 35 U.S.C. 154(b) by 309 days.

This patent is subject to a terminal disclaimer.

(21) Appl. No.: 10/491,031

(22) PCT Filed: Aug. 22, 2002

(86) PCT No.: PCT/JP02/08462

§ 371 (c)(1),
(2), (4) Date: Mar. 26, 2004

(87) PCT Pub. No.: WO03/028497

PCT Pub. Date: Apr. 10, 2003

(65) Prior Publication Data

US 2004/0250829 A1 Dec. 16, 2004

(30) Foreign Application Priority Data

Sep. 28, 2001 (JP) ..... 2001-302537

(51) Int. Cl.
*A41G 3/00* (2006.01)
*A41G 5/00* (2006.01)

(52) U.S. Cl. ..... 132/53; 132/201

(58) Field of Classification Search ..... 132/56, 132/53, 54–55, 201; 300/1, 21
See application file for complete search history.

(56) References Cited

U.S. PATENT DOCUMENTS 5,875,788 A * 3/1999 Loren ..... 132/53
5,921,253 A * 7/1999 Jeong ..... 132/201

FOREIGN PATENT DOCUMENTS

| | | |
|---|---|---|
| JP | 49 24474 | 3/1974 |
| JP | 51-70062 A | 6/1976 |
| JP | 59-36707 | 2/1984 |
| JP | 02-118110 | 5/1990 |

* cited by examiner

*Primary Examiner*—John J. Wilson
*Assistant Examiner*—Robyn Doan
(74) *Attorney, Agent, or Firm*—Keusey, Tutunjian & Bitetto, P.C.

(57) ABSTRACT

An apparatus includes a supplying unit for supplying artificial hairs onto one surface of a base and a needle movable in a direction perpendicular to the surface of the base. The needle pierces the base in a stretched condition to draw out the artificial hairs toward the opposite surface of the base. The base is supplied to a top surface of a conveyor table movable on a two-dimensional plane in perpendicular directions, movement thereof being controlled to be done at a predetermined pitch in a predetermined order, so that the base becomes stretched. In this stretched condition, the artificial hairs are transplanted. After hair-transplantation, the stretched condition is released. This prevents needle holes, formed by hair-transplantation, from being connected with each other to form a continuous slit.

6 Claims, 32 Drawing Sheets

ENLARGED VIEW OF A' PART

FIG. 11A
FIG. 11Aa
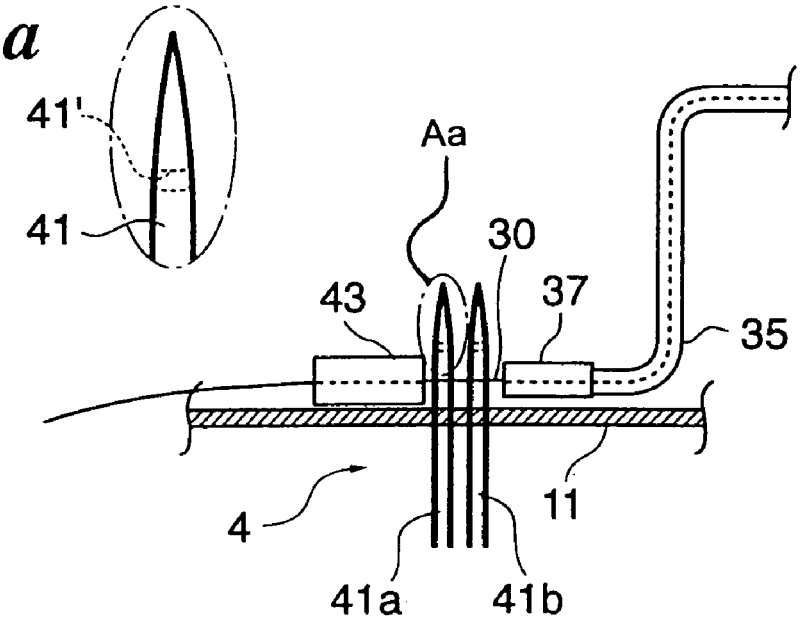
FIG. 11B
FIG. 11Ba
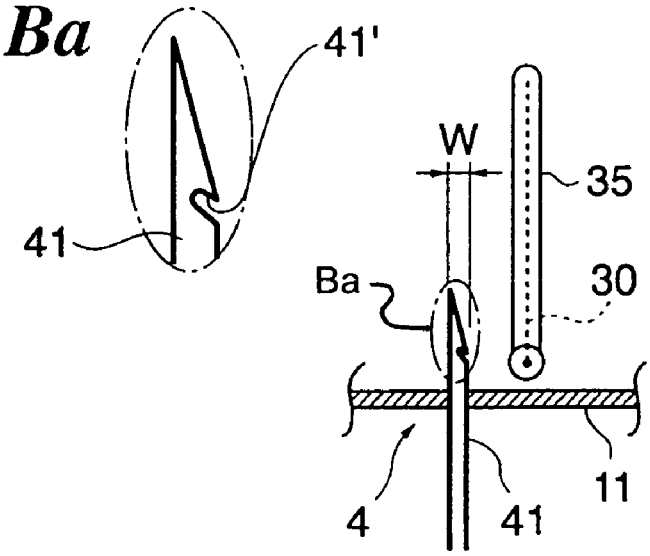

AUTOMATIC HAIR IMPLANTER FOR MANUFACTURING WIG AND METHOD OF MANUFACTURING WIG

TECHNICAL FIELD OF THE INVENTION

The present invention relates to an automation of wig manufacturing and, more particularly to an automated hair-transplanting apparatus for manufacturing a wig and a method of manufacturing a wig.

DESCRIPTION OF RELATED ART

A wig has been manufactured in such a manner that a hair segment to be transplanted is folded in two, which is one by one transplanted onto a three-dimensional thick base by handwork. When one folded hair segment is transplanted on the base, it looks as if two hairs are transplanted. Several folded hair segments may be transplanted at one time.

However, such a prior art handwork is extremely inefficient, because it would take two or three weeks or more to transplant 20,000 hairs, for example. When a wig is manufactured in foreign countries in order to save labor costs, it tends to increase inferior products and reduce a production yield.

Some attempts have been made to develop automated wig manufacturing systems, but no success has been achieved.

To achieve the above-described object, the present invention has been made in view of the above-described background. Its object is to provide an automated hair-transplanting apparatus for manufacturing a wig and a method of manufacturing a wig, which makes it possible to achieve automation of wig manufacturing, manufacture a wig quickly and efficiently while preventing inferior products.

SUMMARY OF THE INVENTION

To achieve the above-described object, an automated hair-transplanting apparatus for manufacturing a wig in accordance with the present invention is characterized by comprising: a conveyor table, base supplying means for supplying a base onto said conveyor table, tensioning/positioning means for applying tension to said base which has been supplied onto said conveyor table by said base supplying means so that said base is placed in position in a stretched condition, artificial hair supplying means for supplying artificial hairs of predetermined length onto one surface of said base which has been supplied onto said conveyor table by said base supplying means and positioned in the stretched condition by said tensioning/positioning means; a needle movable in a direction perpendicular to the surfaces of said base, said needle piercing said base from the other surface to said one surface and then engaging at said one surface said artificial hair supplied by said artificial hair supplying means and then returning back to said other surface so that said artificial hair is drawn out toward said other surface of said base to be transplanted onto said base; table driving means for moving said conveyor table in X and Y directions perpendicular to each other with predetermined pitch so that said artificial hair transplanting operation by said needle is repeated with said predetermined pitch;and tension releasing means for releasing said tension given by said tensioning/positioning means to release said stretched condition of said base onto which said artificial hair have been transplanted, after said artificial hair transplanting operation with said needle has been completed.

A method of manufacturing a wig in accordance with the present invention comprises the steps of supplying a two-dimensional thin base onto a conveyor table, applying tension to stretch said base on said conveyor table, positioning said stretched base on said conveyor table, supplying artificial hairs to one surface of said stretched base, engaging said supplied artificial hairs with needle reciprocating to pierce said stretched base, said needle engaging said artificial hairs piercing said base so that said artificial hairs are transplanted onto said stretched base, said artificial hair transplanting operation by said needle being repeated during movement of said conveyor table with a predetermined pitch, and releasing said stretched condition of said base after completing said artificial hair transplanting operation with said needle. This method may further comprise a first adhesive applying step for applying first adhesive to a back surface of said base so as to fix said transplanted artificial hairs onto said base, and a second adhesive applying step for applying second adhesive to said one surface of said base.

This manner of operation prevents needle holes, formed by hair-transplantation, from being connected with each other to form a continuous slit. This enables automation of wig manufacturing, quick wig manufacturing and prevents inferior products.

Preferably, the artificial hairs are supplied by said artificial hair supplying means onto a lower or upper surface of the base.

The apparatus preferably further comprises press means that may be opened and closed to hold the artificial hairs, the artificial hairs being temporarily held by the press means and drawn out by the needle.

The press means is preferably swingable toward the needle, drawing-out of the artificial hairs by the needle being initiated after swinging movement of the press means toward the needle.

The press means preferably holds the artificial hairs from opposite sides, or from up and down, or both from opposite sides and from up and down.

The needle preferably comprises at least a pair of needles reciprocating in synchronism with each other, said needles being arranged at a predetermined space along a direction of supply of the artificial hairs by said artificial hair supplying means.

A pitch of the artificial hair transplantation with the needle is preferably larger than a needle width defined in a direction perpendicular to a direction of supply of the artificial hairs.

Preferably, the artificial hairs are transplanted by the needle after the base is moved in a direction perpendicular to a direction of supply of the artificial hairs, or after the base is moved in a direction of supply of the artificial hairs, or the artificial hairs are transplanted onto the base in a slanting direction.

Preferably, more than one of said hair supplying means are provided.

The apparatus preferably further comprises means for blowing the artificial hairs, transplanted by the needles, toward a predetermined direction. The blowing means preferably comprises a bar arranged just below the transplanted artificial hairs and movable in a predetermined direction.

Movement of the conveyor table and the needle is preferably controlled by control means comprising a computer.

BRIEF DESCRIPTION OF THE DRAWINGS

FIG. 3 is a view showing an example of a tensioning/positioning unit of the present invention, wherein

FIGS. 8A and 8B are diagrammatic side view showing an example of a blowing unit of the present invention, wherein FIG. 8(A) shows the condition immediately after the artificial hairs have been transplanted, whereas FIG. 8(B) shows the condition wherein the artificial hairs have been blown towards a base.

FIGS. 11A, 11B, 11Aa and 11Ba are views showing elevation of a transplanting needle in accordance with the present invention, wherein FIG. 11(A) is a diagrammatic front view thereof, FIG. 11Aa is an enlarged view of part "Aa" of FIG. 11A, FIG. 11(B) is a diagrammatic left-side view thereof, and FIG. 11Ba is an enlarged view of part "Ba" of FIG. 11B.

FIGS. 12A and 12B are views showing descent of the transplanting needle in accordance with the present invention, wherein FIG. 12(A) is a diagrammatic front view thereof and FIG. 12(B) is a diagrammatic left-side view thereof.

FIGS. 15A and 15B show an example of an electromagnetic valve for use in the automated hair-transplanting apparatus for manufacturing a wig in accordance with the present invention, wherein FIG. 15(A) is a diagrammatic perspective view thereof and FIG. 15(B) is a circuit diagram.

DETAILED DESCRIPTION OF PREFERRED EMBODIMENTS

Figure 1A:
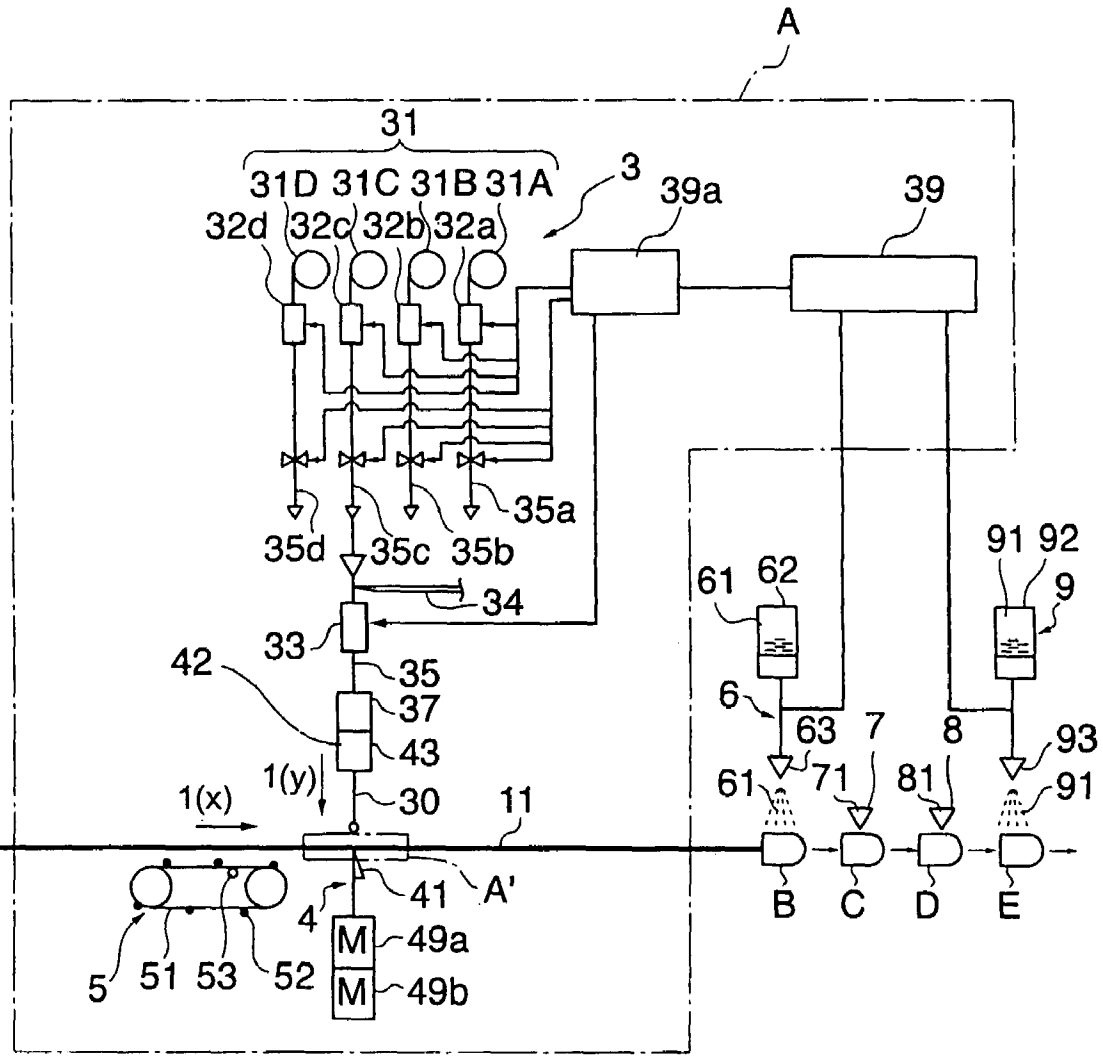
FIG. 1A is a general view showing an embodiment of an automated hair-transplanting apparatus for manufacturing a wig in accordance with the present invention and also diagrammatically showing a process flow.
Figure 1B:
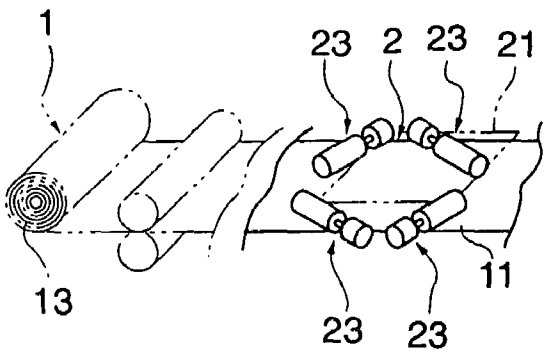
FIG. 1B is an enlarged view of part A' of FIG. 1A.
Figure 2:
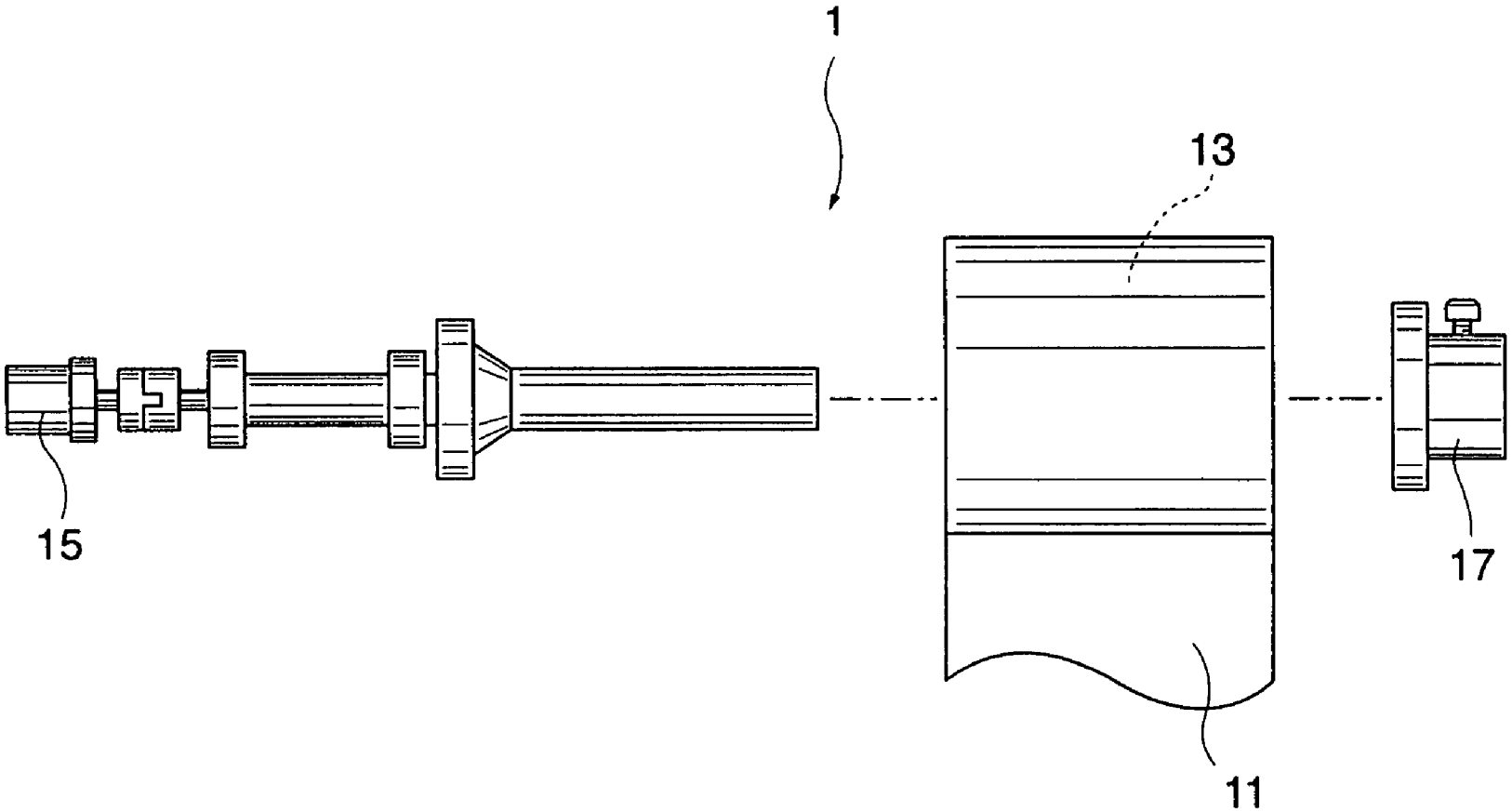
FIG. 2 is a diagrammatic front view showing an example of a base supply unit of the present invention.

Next, an automated hair-transplanting apparatus for manufacturing a wig embodying the present invention will be described in more detail in reference to the accompanying drawings showing embodiments thereof. For the sake of convenience, elements or parts having the same function are indicated by the same reference numerals and explanation thereof will be omitted. FIGS. 1A and 1B are general views diagrammatically showing an automated hair-transplanting apparatus for manufacturing a wig in accordance with the present invention together with a process flow. As shown also in FIG. 2, a base supply unit 1 supplies a base 11 to a tensioning/positioning unit 2 in a horizontal orientation. The base 11 is a very thin sheet woven by polyurethane fiber, for example, having a thickness of 0.06 mm, for example, which is reeled around a sheet roller 13. The sheet roller 13 is driven by a motor 15 to supply the reeled base 11 therefrom onto a conveyor table 21. A reference numeral 17 indicates a sheet roller stopper.

Figure 3A:
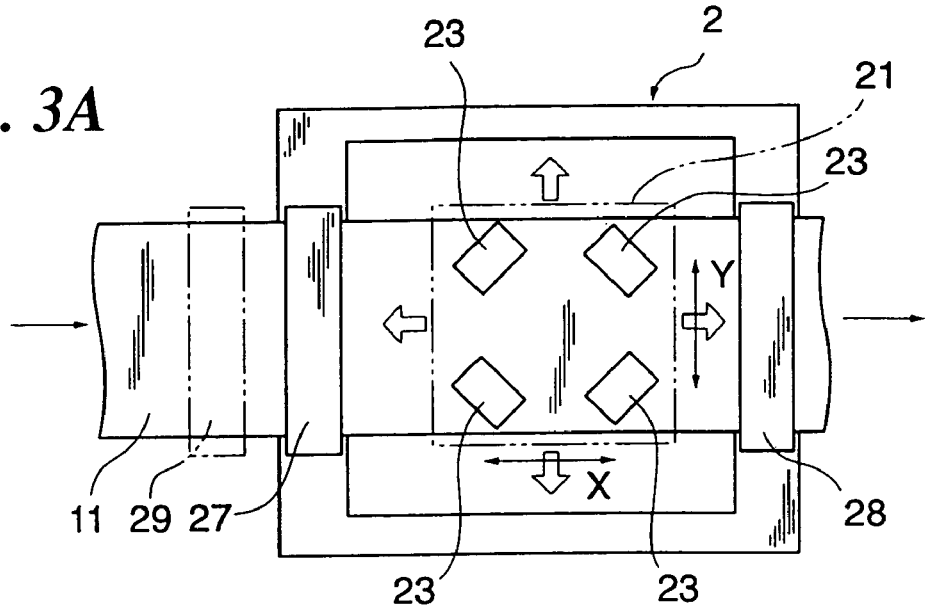
FIG. 3(A) is a diagrammatic plan view thereof.
Figure 3B:
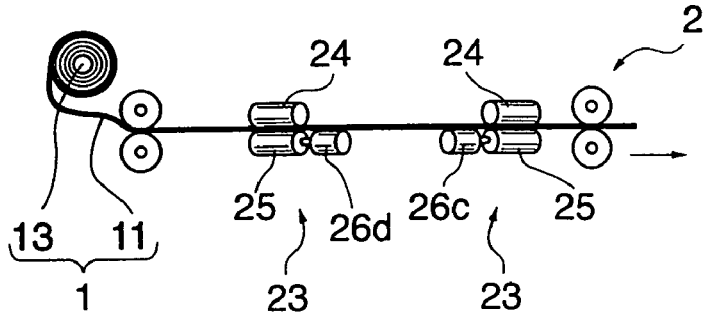
FIG. 3(B) is a diagrammatic front view thereof and FIG. 3(C) is a diagrammatic plan view showing a main part thereof.
Figure 3C:
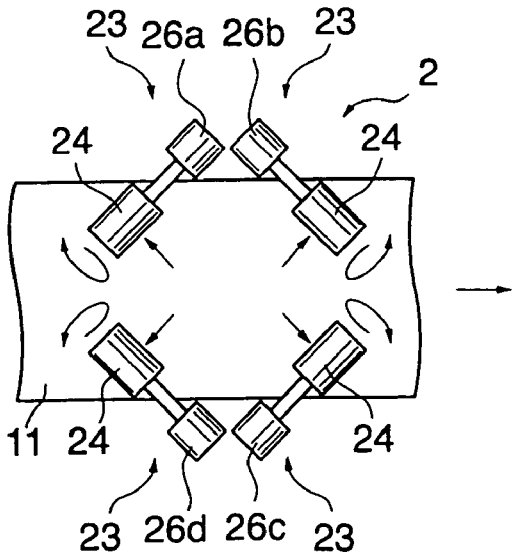

FIG. 3 shows the tensioning/positioning unit 2. The tensioning/positioning unit 2 has conveyor table 21 movable on a two-dimensional plane in directions perpendicular to each other, that is, along X- and Y-axes. The conveyor table 21 is moved along X- and Y-axes over a predetermined pitch of 2 mm, for example, by an X-axis drive motor (not shown) and a Y-axis drive motor (not shown), respectively, in a predetermined order. By this, the base 11 becomes stretched and is positioned in a predetermined position. More particularly, there are tensioners 23 at four corners on the conveyor table 21 for tensioning the supplied base 11. Each tensioner 23 comprises a pair of opposed tension nip rollers 24, 25 for pressing and clamping the base 11 from up and down, and tensioning motors 26 (26*a*, 26*b*, 26*c*, 26*d*) that may be rotated in forward and reverse directions to drive the rollers 24, 25. A reference numeral 27 indicates upper and lower sheet feeding rollers arranged at a supply side of the tensioning/positioning unit 2, which are driven by a motor 27*a*, shown in FIG. 14, to rotate in one predetermined direction for feeding the base 11 onto the conveyor table 21. A reference numeral 28 indicates upper and lower sheet discharging rollers arranged at a discharge side of the tensioning/positioning unit 2, which is rotatable in forward and reverse directions by a motor 28*a*, shown in FIG. 14. A reference numeral 29 indicates a sheet slack sensor 29 mounted at the supply side of the tensioning/positioning unit 2, upstream of the sheet feeding rollers 27, for detecting a slack of the supplied base 11.

Figure 4:
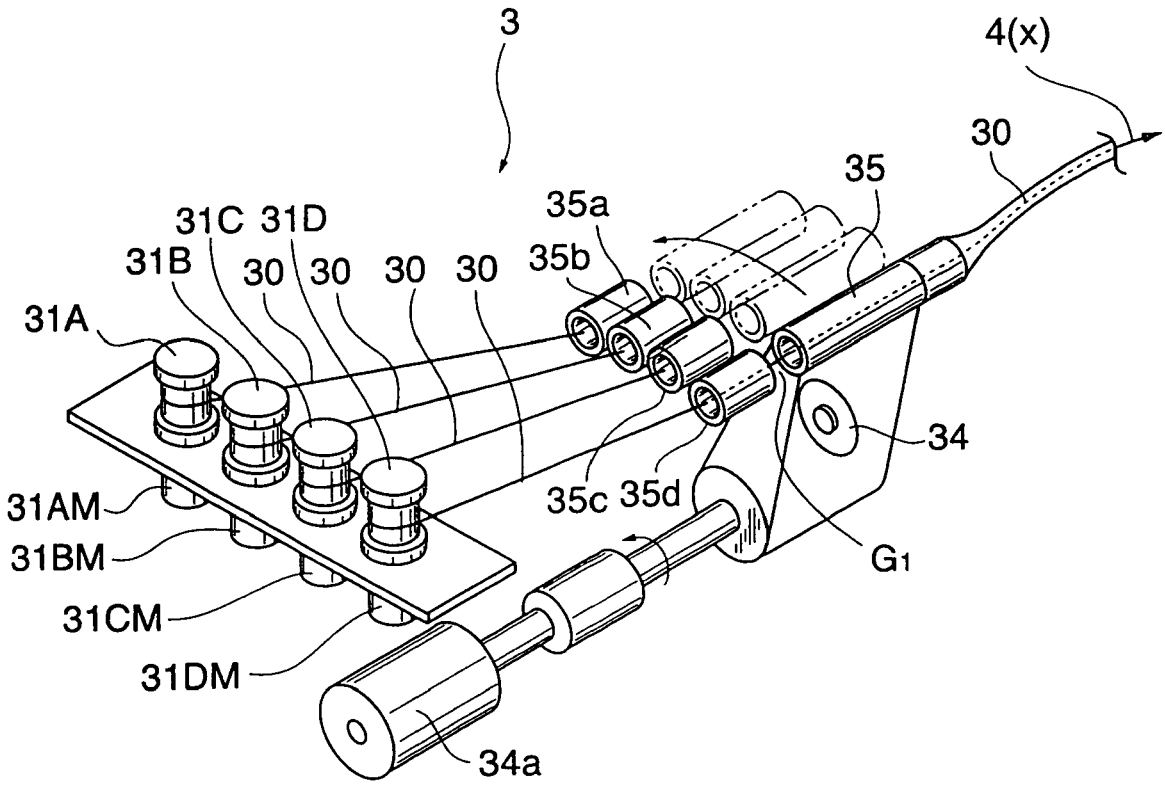
FIG. 4 is a diagrammatic perspective view showing an example of a part, namely a hair color selecting and cutting unit of an artificial hair supply unit of the present invention.

An artificial hair supplying unit 3 shown in FIG. 4, including bobbins 31A, 31B, 31C and 31D (which may be hereinlater referred to by a generic numeral 31), supplies an artificial hair 30 onto the upper surface of the base 11. A thread (or the artificial hair 30) of a different color is reeled around each bobbin 31, which may be unreeled from the bobbin over a predetermined length by an unreeling motor 31AM, 31BM, 31CM, 31DM. The unreeled thread is fed by actuating a vacuum generator 32 (32*a*, 32*b*, 32*c*, 32*d*) and a single vacuum generator 33, shown in FIG. 1. Each bobbin system 31 has a conduit 35*a*, 35*b*, 35*c*, 35*d* that forms a travel path, and the artificial hairs 30 are supplied through the conduit 35*a*, 35*b*, 35*c*, 35*d* and a conduit 35 to a hair-transplanting unit 4. It is to be noted that a flow of hair 1(y) is generally along a Y axis and a flow of base 1(x) is generally along a X axis, as indicated by the respective arrows.

As shown in FIG. 4, in the middle of each travel path, there is a movable cutter 34 driven by a cutter motor 34*a* for cutting the respective artificial hairs 30 after they are unreeled over a predetermined length by the unreeling motors 31AM, 31BM, 31CM, 31DM. Between the conduit 35 and the conduits 35*a*, 35*b*, 35*c*, 35*d* are formed gap G1 that allows the cutter 34 to pass therethrough. The artificial hair 30 may comprise, for example, polyester, acrylic or other chemical fiber that has been subjected to special treatment for use as an artificial hair. The respective artificial hairs 30 are supplied through the conduit 35. Arrow 4(*x*) indicates a direction to a hair-transplanting unit, to which artificial hair 30 is directed.

Figure 5:
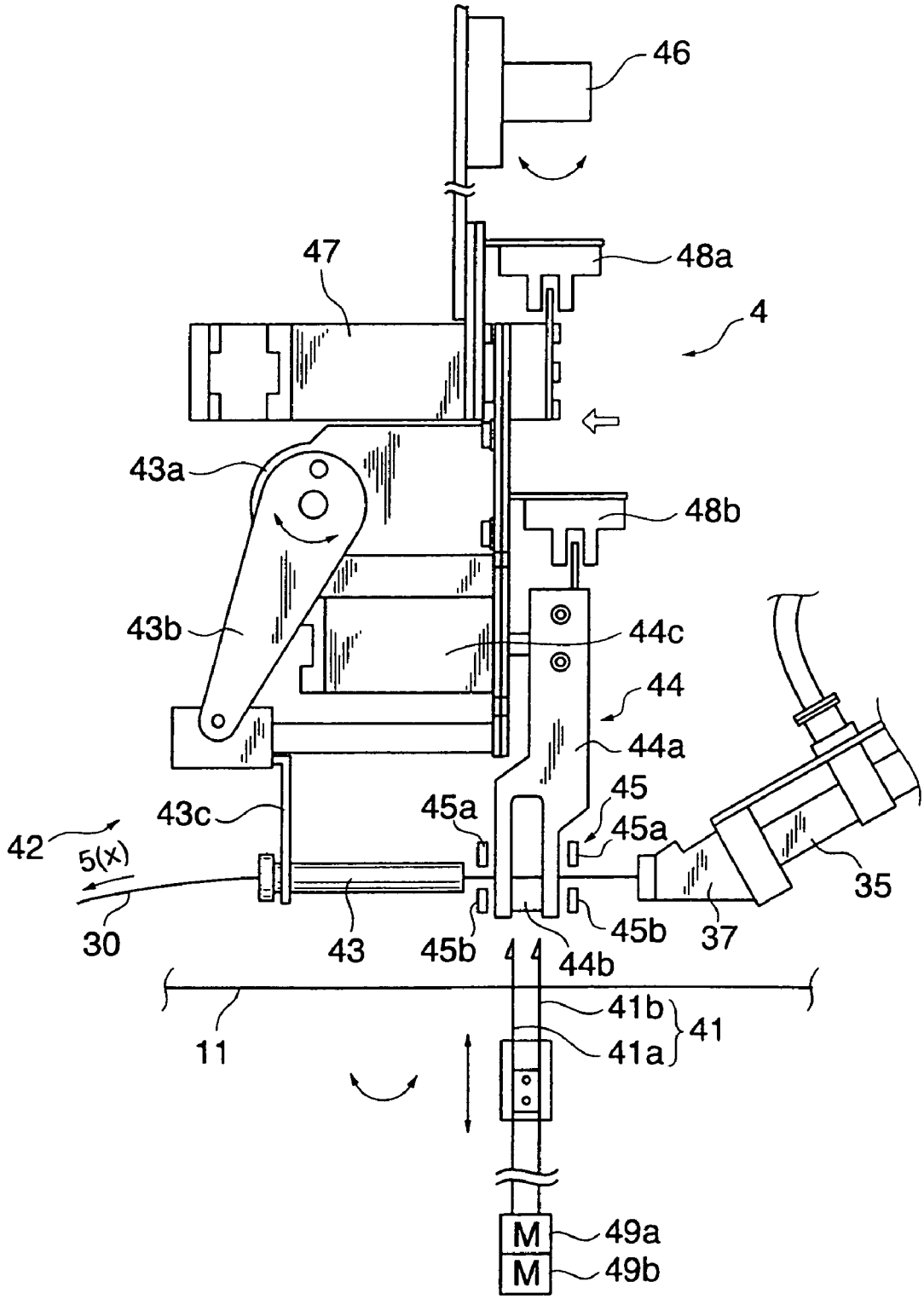
FIG. 5 is a front view showing an example of a hair-transplanting unit of the present invention.
Figure 6A:
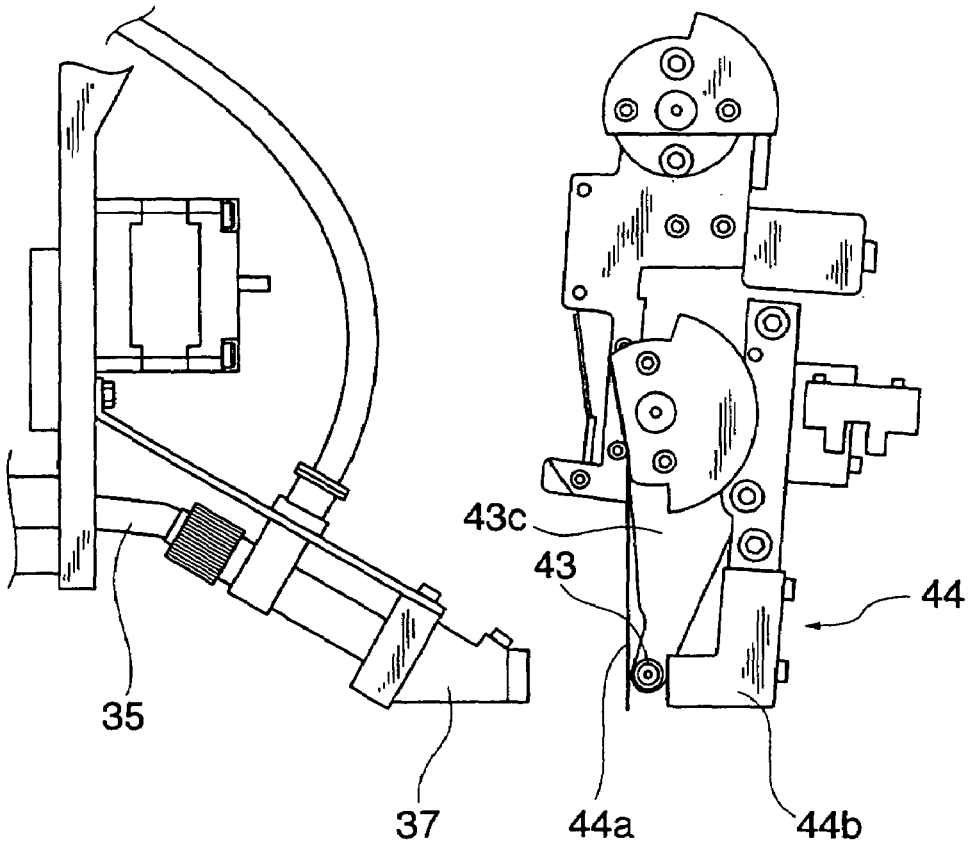
FIG. 6(A) is a side view of FIG. 5.
Figure 6B:
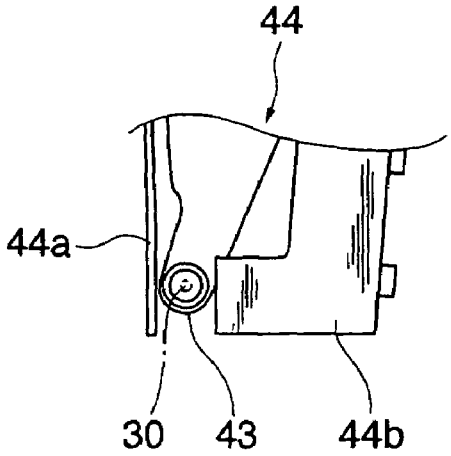
FIG. 6(B) is an enlarged view showing a part thereof when presser means is opened.
Figure 6C:
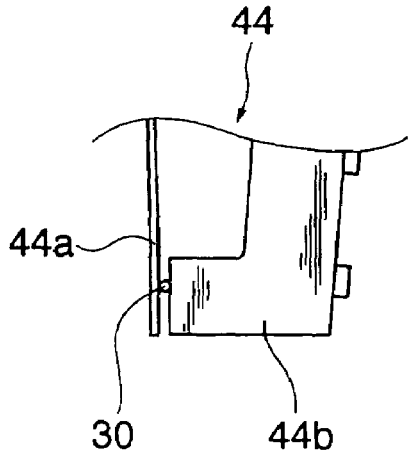
FIG. 6(C) is an enlarged view showing the same part when presser means is closed.
Figure 7:
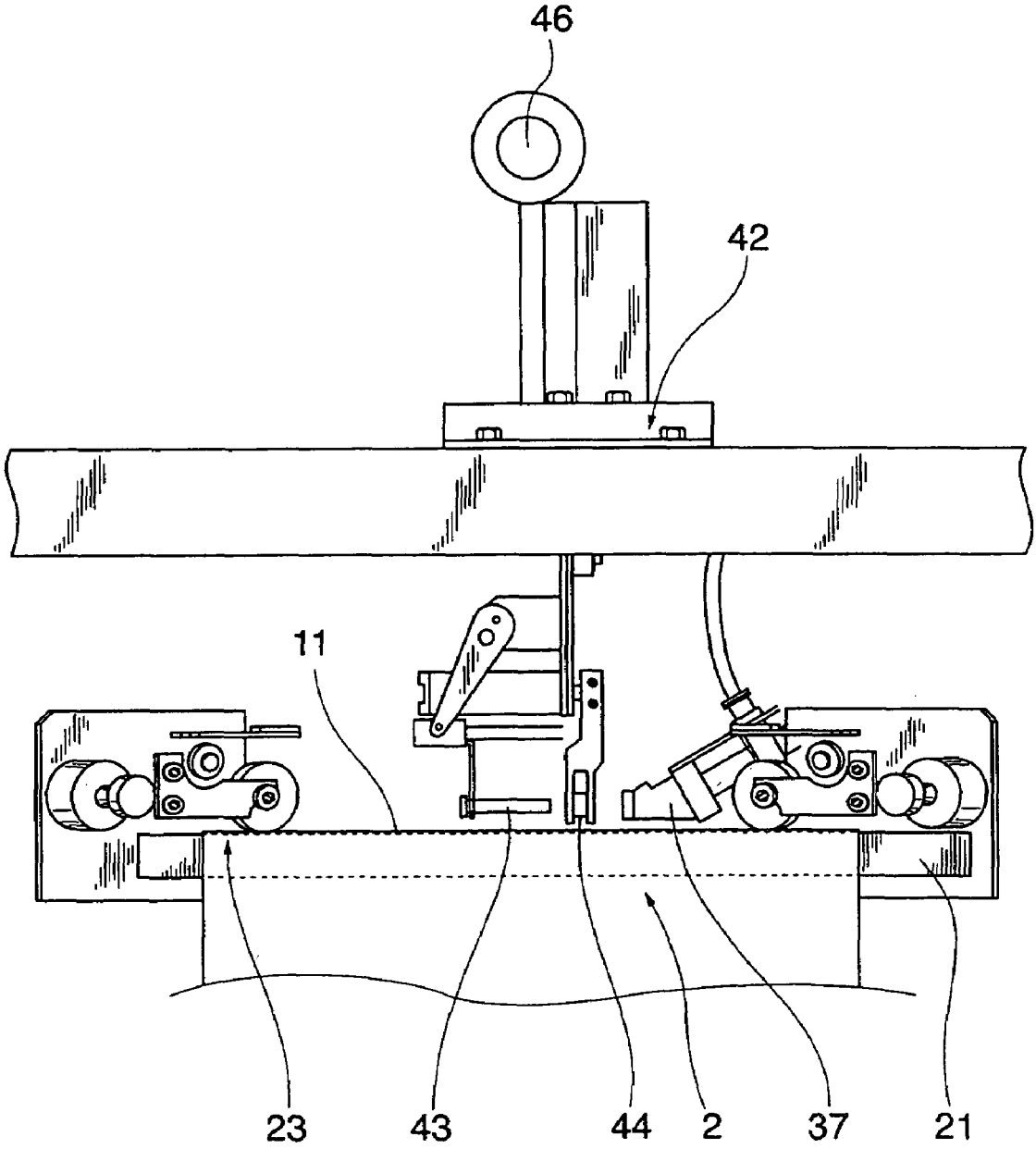
FIG. 7 is a diagrammatic perspective view showing relationship between a head unit and a conveyor table of the present invention.

FIGS. 5–7 show the hair-transplant unit 4. The hair-transplant unit 4 comprises vertically reciprocatable needles 41 (41*a*, 41*b*) arranged below the base 11 and a head 42 arranged above the base 11 and just above the needles 41. The head 42 is provided with a movable guide 43 in the form of a pipe detachably connected to an artificial hair supplying nozzle 37 attached to the leading end of the conduit 35, and press means 44, 45 that may be opened and closed for clamping the artificial hair 30 that has been removed from the movable guide 43 and the artificial hair supplying nozzle 37, and is driven by a motor 46 to rotate on horizontal plane of the base 11. A reference numeral 43*a* indicates a motor for reciprocating the movable guide 43 on a horizontal plane, which drives the movable guide 43 via a lever 43*b* connected to a motor shaft and a connector plate 43*c*. The press means 44 comprises a movable member 44*a* driven by a motor 44*c* to be opened and closed, and a stationary receiving member 44*b*, between which the artificial hair 30 is clamped from opposite sides thereof. The press means 45 comprises members 45*a*, 45*b* that are moved up and down in synchronism with movement of the movable member 44*a* to clamp the artificial hair 30 therebetween. A reference numeral 47 indicates a motor for swinging the head 42, including the press means 44, toward the needles 41. A reference numeral 48*a* indicates a sensor for detecting a rotational angle of the head 42. A reference numeral 48*b* indicates a sensor for detecting a rotational angle of the press means 44. A reference numeral 49*a* indicates a motor for reciprocating the needles 41, and a reference numeral 49*b* indicates a motor operative in synchronism with the motor 46 to rotate the needles 41 on a horizontal plane with respect to the plane of the base 11. In FIG. 5, the artificial hair 30 is transferred in an arrowed direction 5(x) (in a direction of X-axis) with respect to the base 11. The needle 41 has a speared or pointed end provided with a groove 41'. The needle 41 comprises two needles 41*a*, 41*b* supported to a vertically reciprocatable needle arm (not shown) with a predetermined gap of 1 mm, for example, therebetween. The needles 41*a*, 41*b* are positioned with their grooves 41' extending in the same direction that is perpendicular to the artificial hair 30.

Figure 8A:
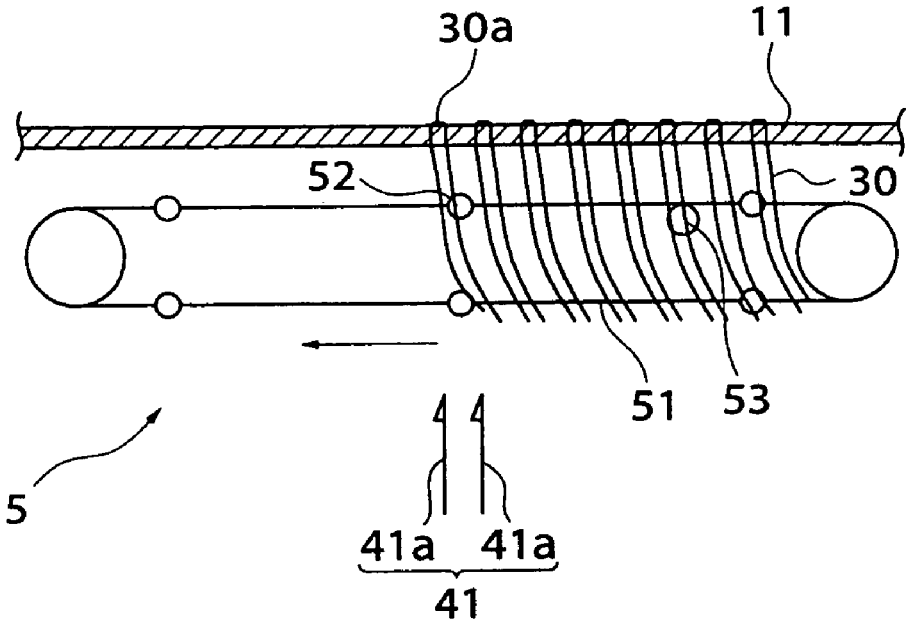
Figure 8B:
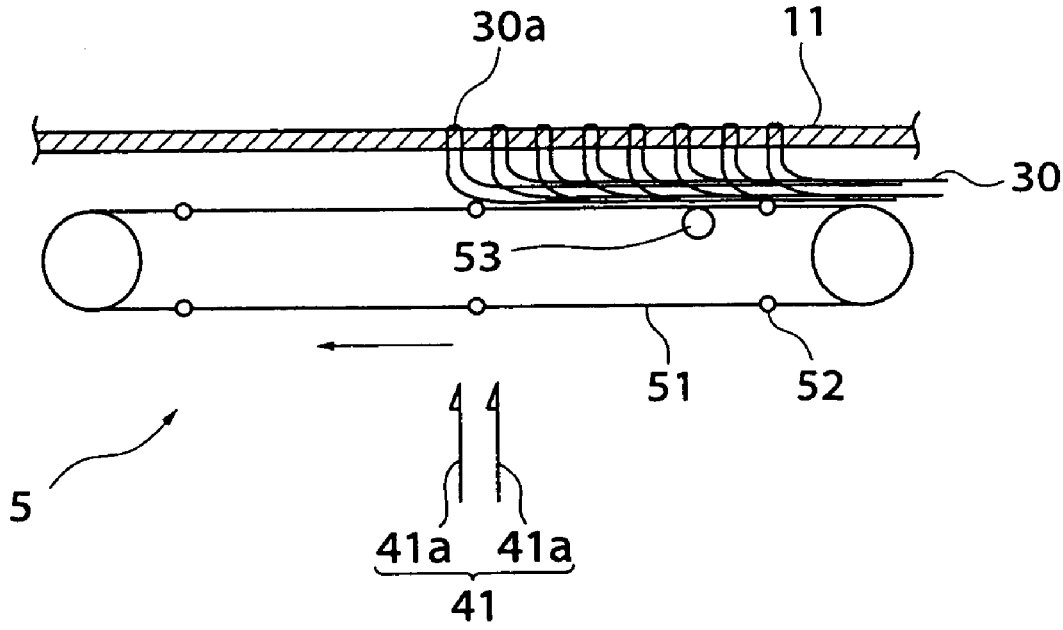
Figure 9A:
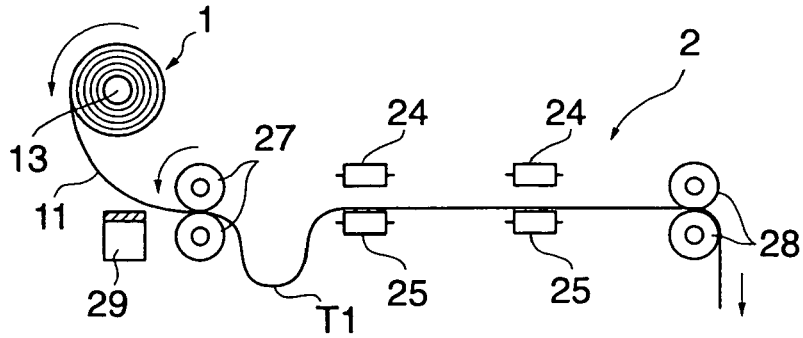
FIGS. 9A, 9B, 9C and 9D are (diagrammatic side) views explaining the manner of applying tension to the base.
Figure 9B:
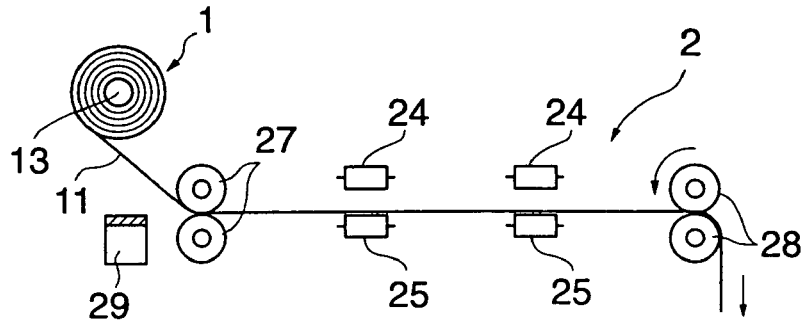
Figure 9C:
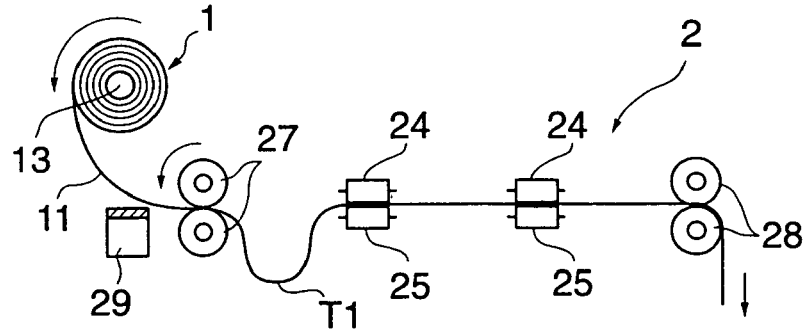
Figure 9D:
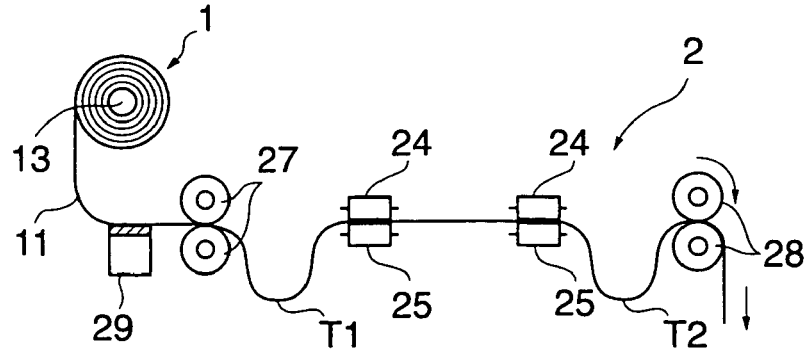
Figure 10A:
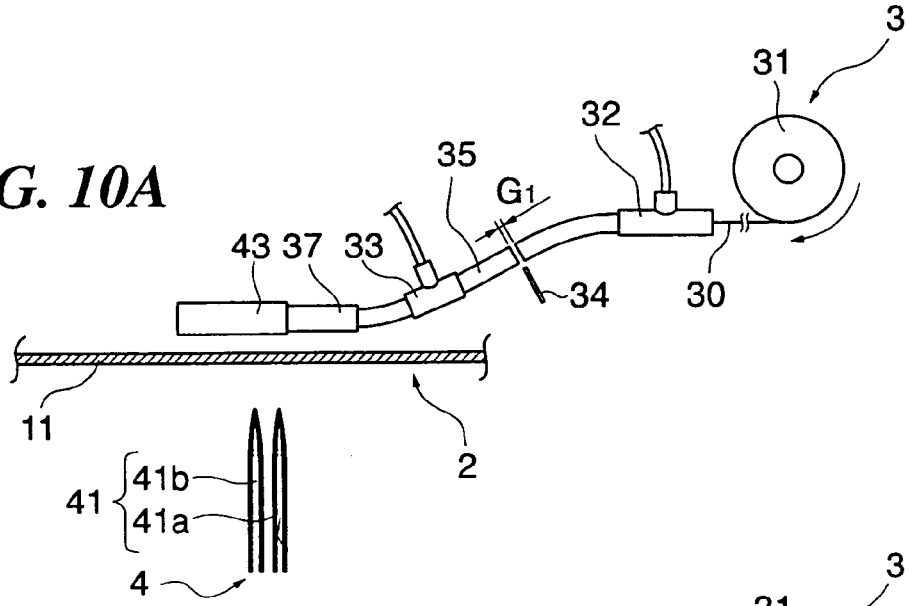
FIGS. 10A, 10B, 10C and 10D are diagrammatic front views showing the artificial hair supplying process in accordance with the present invention.
Figure 10B:
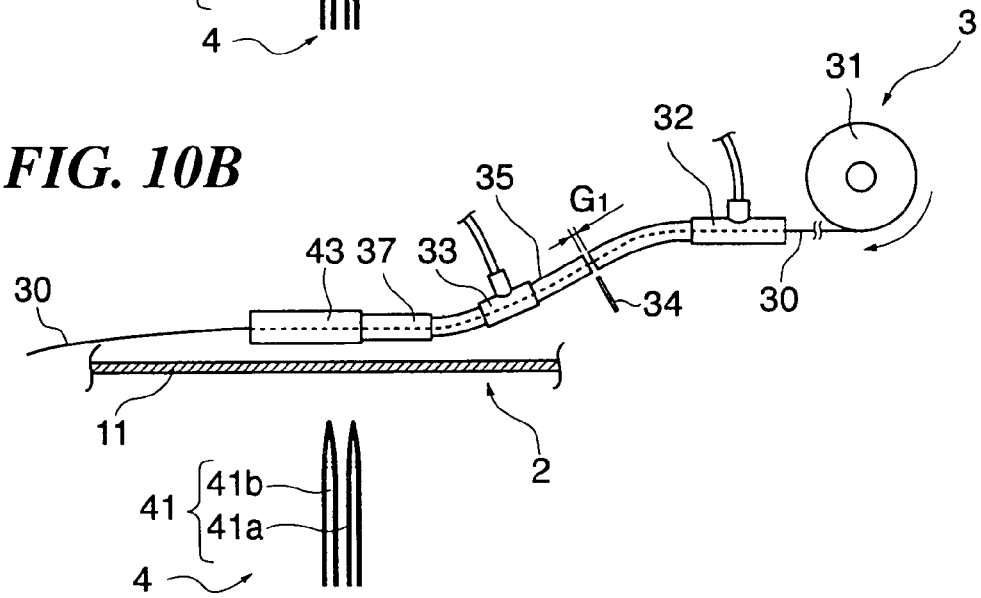
Figure 10C:
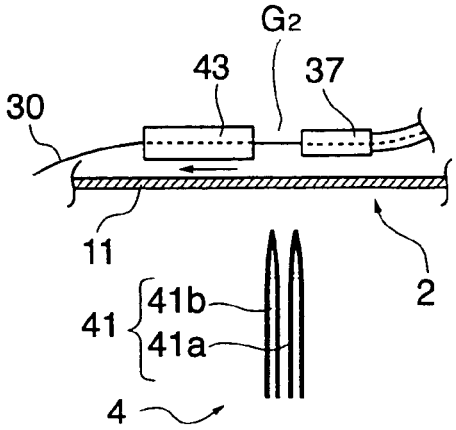
Figure 10D:
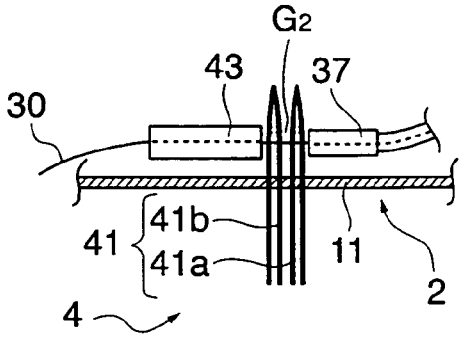
Figure 12A:
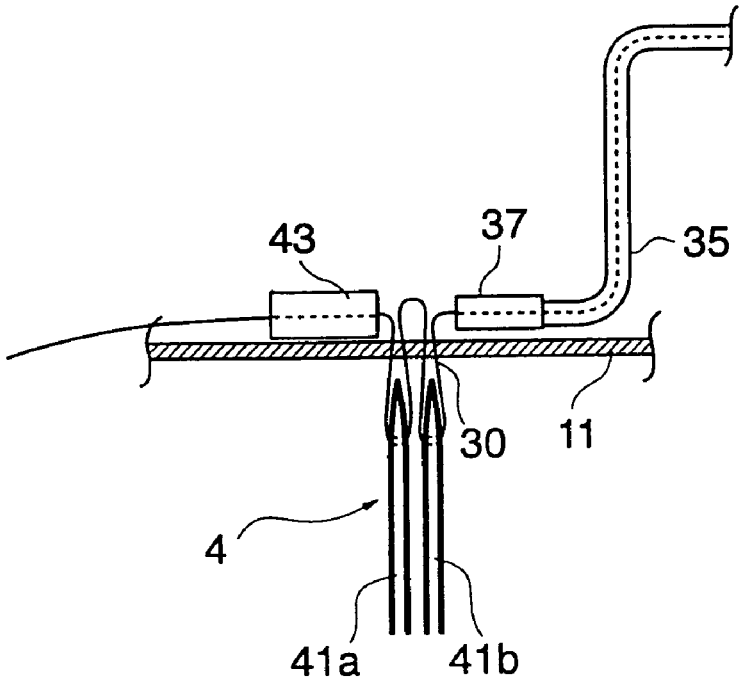
Figure 12B:
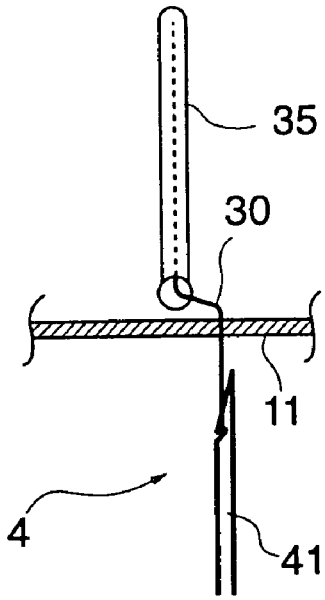
Figure 13:
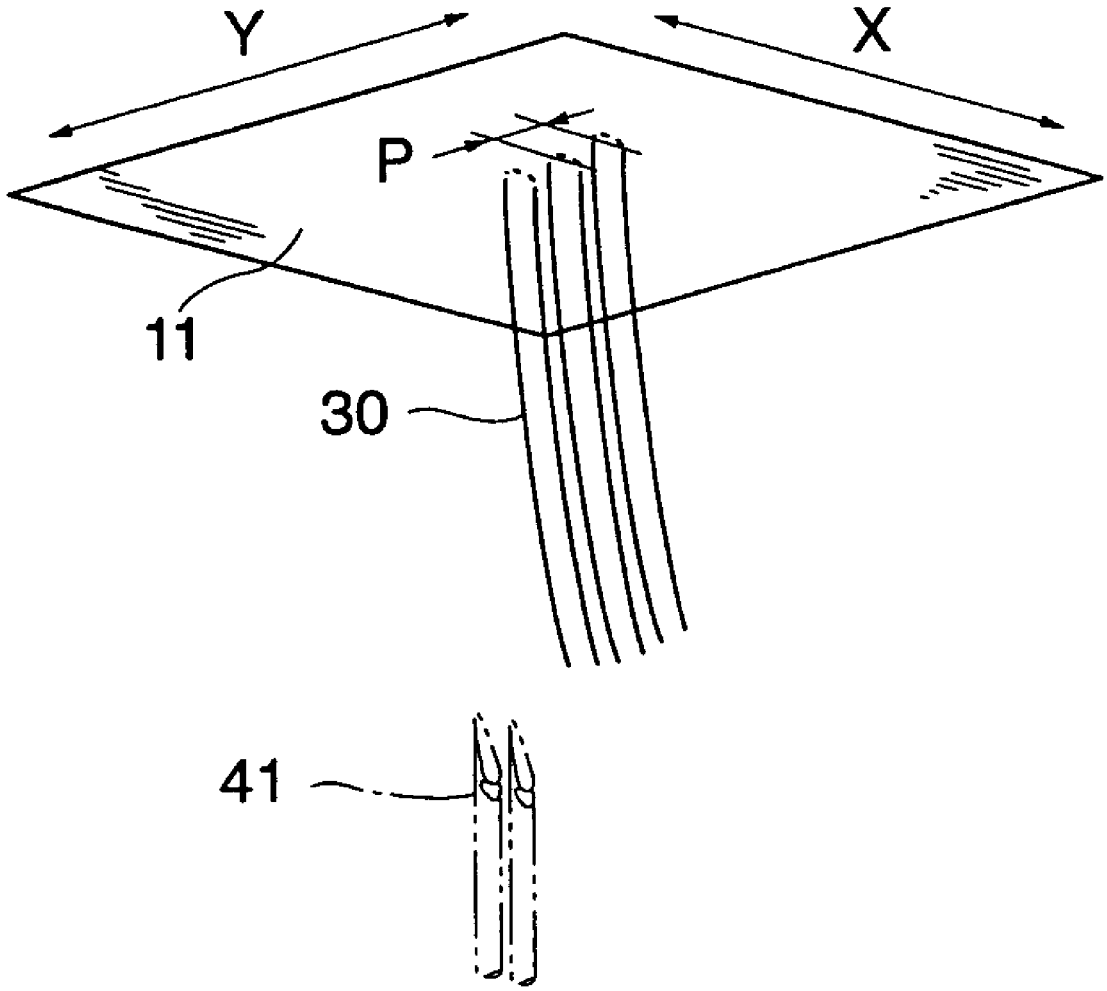
FIG. 13 is a view showing the condition where the artificial hairs have been transplanted onto the base.

FIG. 8 shows a hair-blowing unit 5 in the hair-transplanting unit 4. More particularly, just below the transplanted artificial hair 30 is arranged a chain conveyor 51 that rotates clockwise, and the conveyor 51 is provided with a plurality of raking bars 52. A holding bar 53 is suitably separated from the transplanted artificial hairs 30. The conveyor 51 is driven to rotate at a predetermined time interval so that the raking bars 52 rake the transplanted artificial hairs 30 to right, which are then held by the holding bar 53. This assures that next transplanting operation may be done with no obstacles on an area to be hair-transplanted.

Figure 15A:
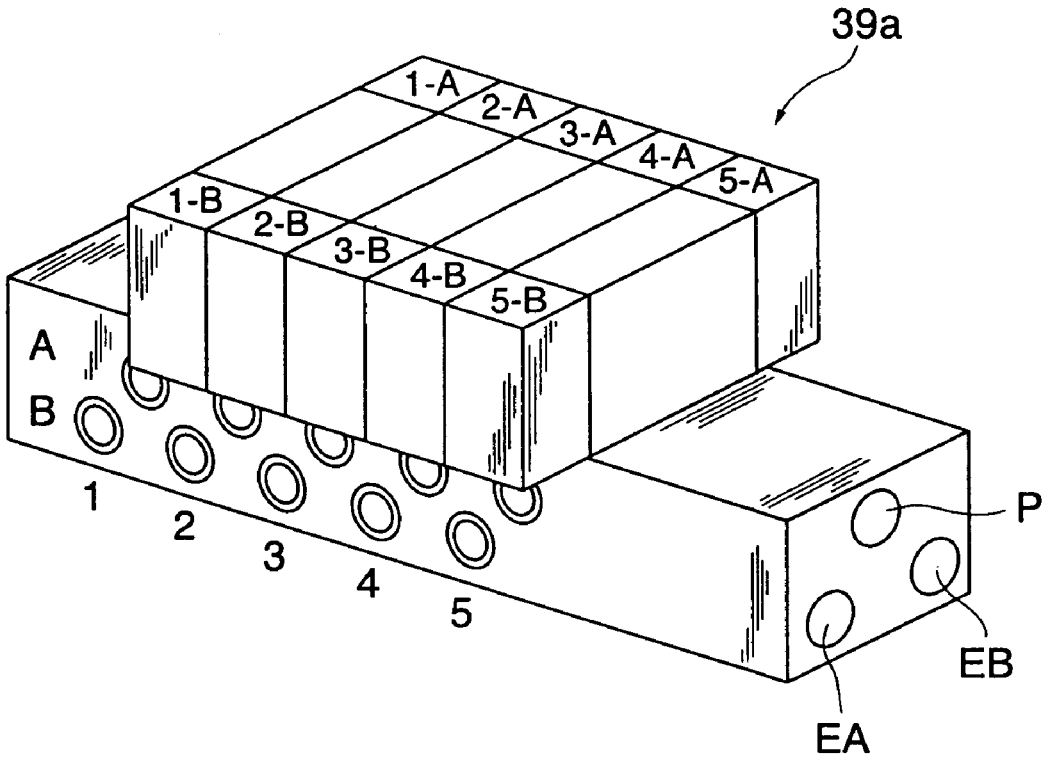
Figure 15B:
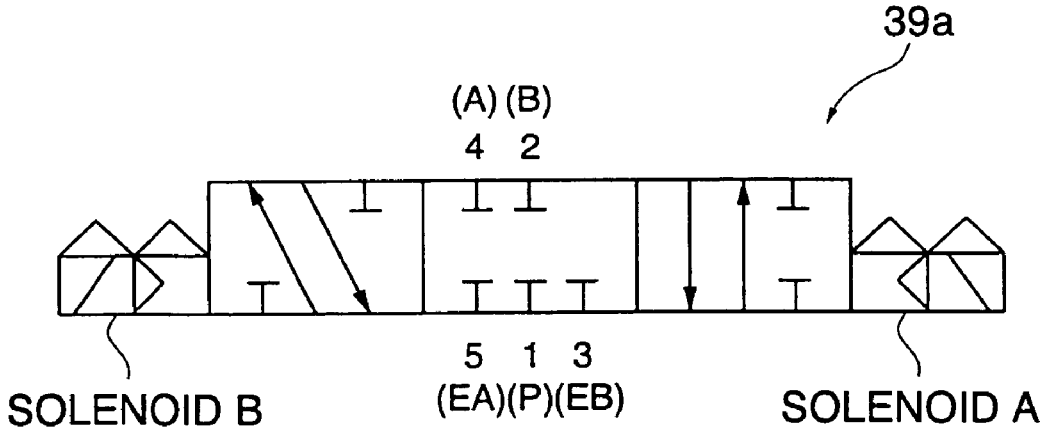

Shown in FIG. 15 is an electrostatic valve (three position, closed center double solenoid) 39*a* that is linked with an air compressor 39 to actuate the vacuum generators 32, 33.

Next, operation of the automated hair-transplanting apparatus for manufacturing a wig in accordance with the present invention will be described in reference to FIGS. 9–14. A slack T1 is first given between the sheet feeding rollers 27 and the tension nip rollers 24, 25 (FIG. 9(A)), and the discharge roller 28 is driven to rotate to feed the base 11 (FIG. 9(B)). Up to this time, the tension nip rollers 24, 25 remains opened. Next, the tension nip rollers 24, 25 are closed to hold the supplied base 11 therebetween, thereby again providing a slack T1 between the sheet feeding rollers 27 and the tension nip rollers 24, 25 (FIG. 9(C)). Then, the sheet discharging rollers 28 are driven to rotate in a reverse direction to provide another slack T2 between the tension nip rollers 24, 25 and the sheet discharging rollers 28 (FIG. 9(D)). The total amount of the slacks T1 and T2 thus given should be enough to move the conveyor table 21. The hatched portion of the sheet slack sensor 29 in FIG. 9 indicates a detectable area. The base 11 is transferred from left to right.

The base 11 thus fed is nipped from top and bottom between the tension nip rollers 24, 25 to become stretched on the conveyor table 21 (see FIG. 3). Then, predetermined data designating a pitch of hair-transplantation, coloring of the artificial hairs 30, etc. are read out by control means comprising a computer, not shown, according to which hair-transplanting process will start. The color scheme of the artificial hairs 30 is determined in advance as a combination of 50% of the hair from the bobbin 31A, 30% from the bobbin 31B, 15% from the bobbin 31C and 5% from the bobbin 31D, for example.

Prior to the hair-transplanting process, the artificial hairs 30 have been supplied to above the base 11. Supply of the artificial hair 30 is carried out by the vacuum generators 32, 33 that are driven in response to a command from the control means to absorb by vacuum the thread. More specifically, when the artificial hair 30 of "A" color is to be selected, ports "1-A" and "2-A" of the electromagnetic valve 39*a* (shown in FIG. 15) in the vacuum generator 32 are turned on, and a motor for the bobbin 31A is turned on. When the artificial hair 30 of "B" color is to be selected, ports "1-B"

and "2-B" of the electromagnetic valve 39*a* are turned on, and a motor for the bobbin 31B is turned on. When the artificial hair 30 of "C" color should be selected, ports "3-A" and "4-A" of the electromagnetic valve 39*a* are turned on, and a motor for the bobbin 31C is turned on. When the artificial hair 30 of "D" color is to be selected, ports "3-B" and "4-B" of the electromagnetic valve 39*a* are turned on, and a motor for the bobbin 31D is turned on. When a thread sensor (not shown) comprising a photoelectric tube, for example, detects that the artificial hair 30 reaches a predetermined length, the cutter 34 become operative to cut the artificial hair 30 to a predetermined length. The artificial hair segment 30 thus cut is supplied to above the base 11.

Then, the artificial hair 30 is transplanted. First, the movable guide 43 is moved to right to be connected with the artificial hair supply nozzle 37. At this time, the press means 44, 45 remain opened. When the artificial hair 30 is inserted into the movable guide 43, the movable guide 43 is moved to left to separate from the artificial hair supply nozzle 37. Then, the press means 44, 45 are closed substantially at the same time to hold the artificial hair 30 into a horizontal orientation. While the artificial hair 30 is temporarily fixed in such a manner, the head 42 is driven by the motor 46 to rotate about its axis. At the same time, the needle 41 is driven by the motor 49*b* in synchronism with the motor 46 to rotate about its axis. Then, the needle 41 is moved upward. While the artificial hair 30 is temporarily fixed by the press means 44, 45, it is driven by the motor 47 to rotate toward the needle 41 so that the artificial hair 30 is forced against the needle 41, and then needle 41 is moved downward. An angle of this swinging movement is determined in advance, which is detected by the sensor 48*a*. During descent of the needle 41, the artificial hair 30 goes into the groove 41' of the needle 41 and, therefore, is pulled out by the needle 41 to below the base 11. At this time, the press means 44, 45 remain opened. The conveyor 51 is driven to rotate at a predetermined time interval, and the transplanted artificial hair 30 is raked to right by the raking bars 53. This assures that next transplanting operation may be done with no obstacles on an area to be hair-transplanted. Transplantation of the artificial hair 30 onto the base 11 may be done at a predetermined pitch of 2 mm, for example, in a predetermined order, after the base 11 has been moved in a direction of Y-axis (shown in FIG. 13) that is perpendicular to the direction of supply of the artificial hair 30 (X-axis) or it has been moved in a direction of X-axis.

Figure 14A:
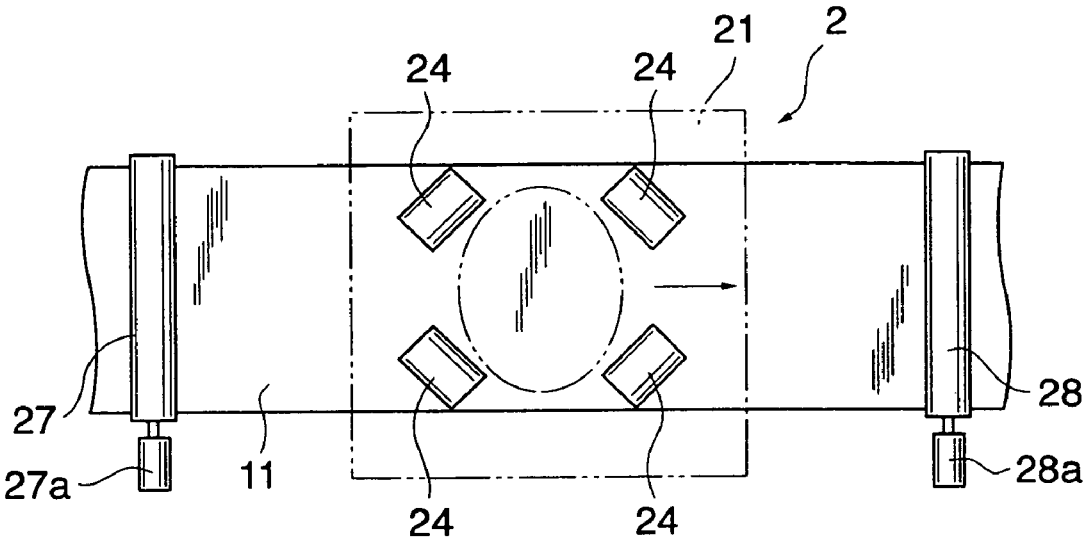
FIGS. 14A and 14B are (diagrammatic plan) views explaining the process succeeding the hair-transplanting process.
Figure 14B:
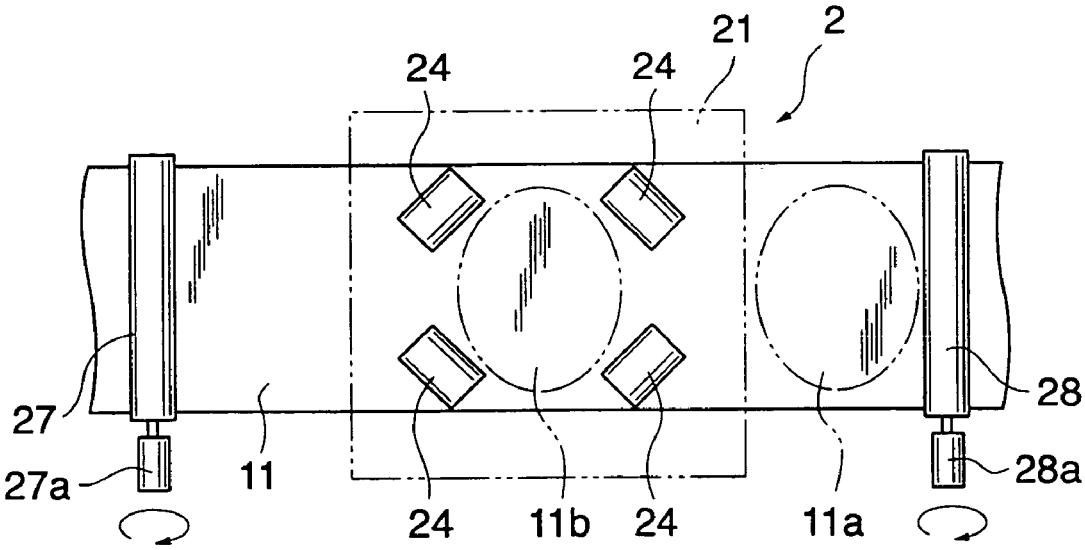

After completing the hair-transplantation in the above-described manner, the stretched condition of the base 11 is released, and the sheet discharging rollers 28 are rotated to discharge the completed base 11*a* (FIG. 14(A)). Next, the base feeding process is again carried out in the aforementioned manner to feed a plane 11*b* as a new base 11 to be hair-transplanted (FIG. 14(B)).

The respective parts, described above, will be controlled by control means comprising a computer, not shown.

The above-described process A will be described in detail in reference to the flowcharts of FIGS. 16–33.

Figure 16:
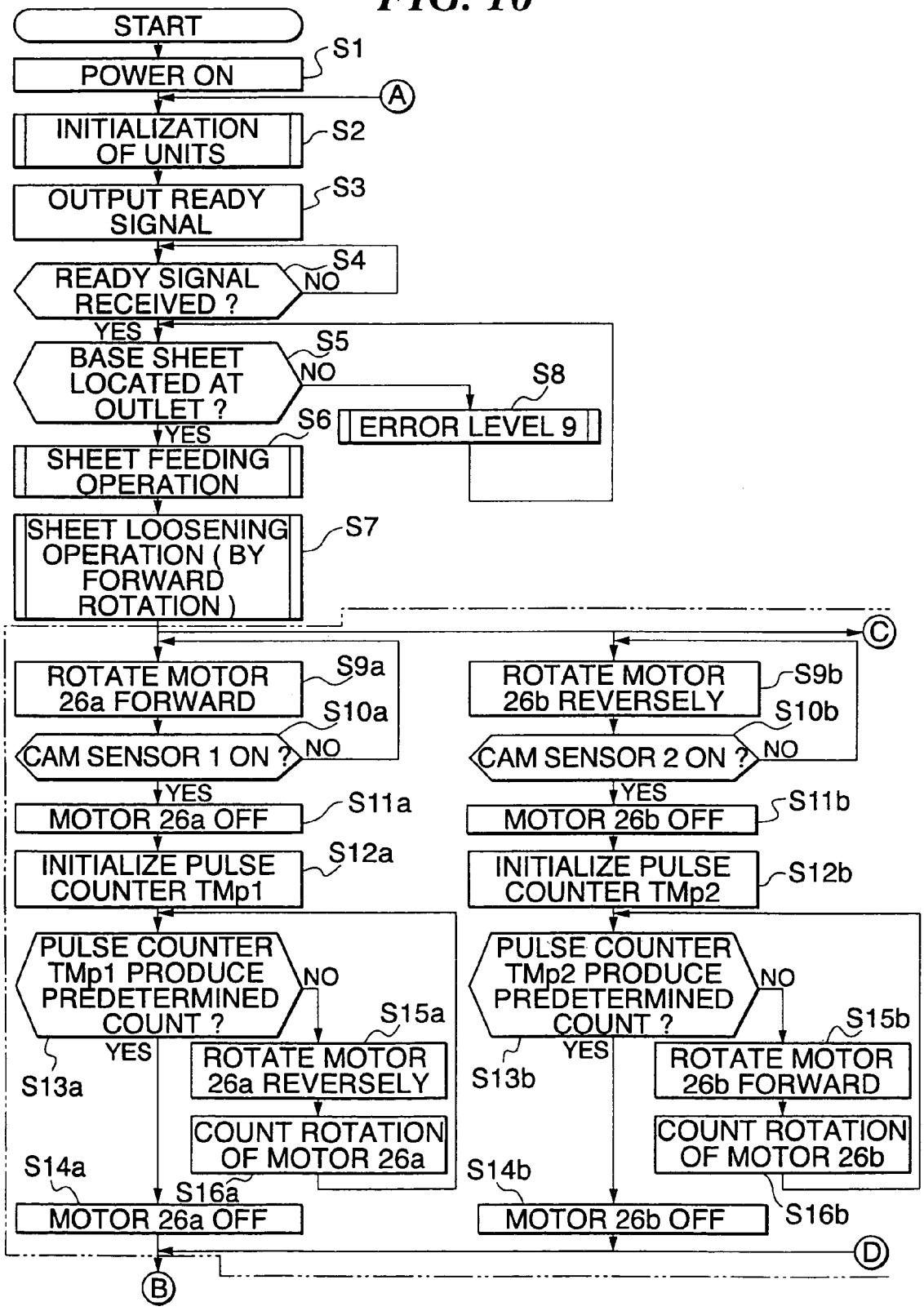
FIG. 16 is (a part of) a flowchart showing a method of manufacturing a wig in accordance with the present invention.
Figure 17:
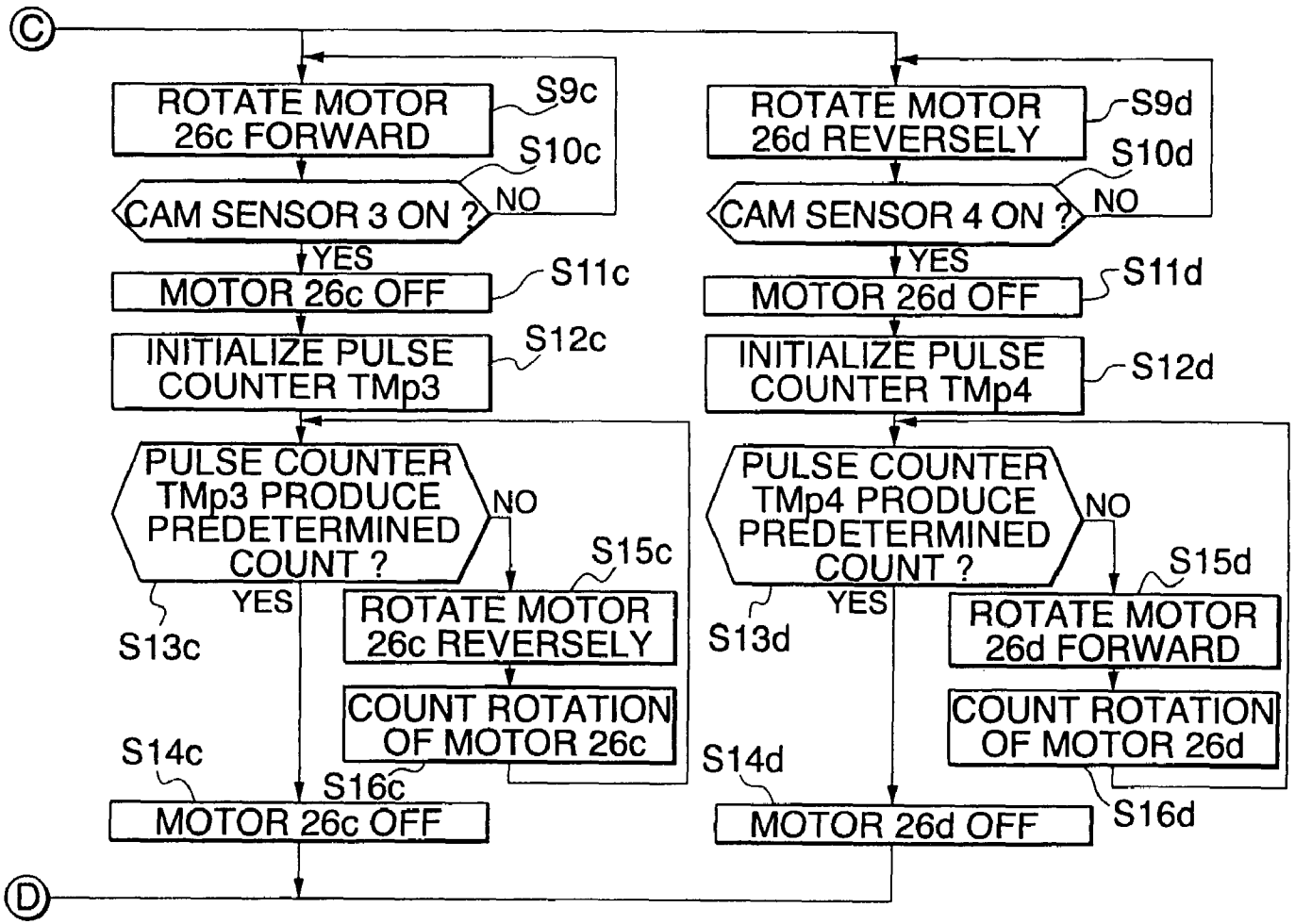
FIG. 17 is (a part of) a flowchart showing the method of manufacturing a wig in accordance with the present invention.
Figure 18:
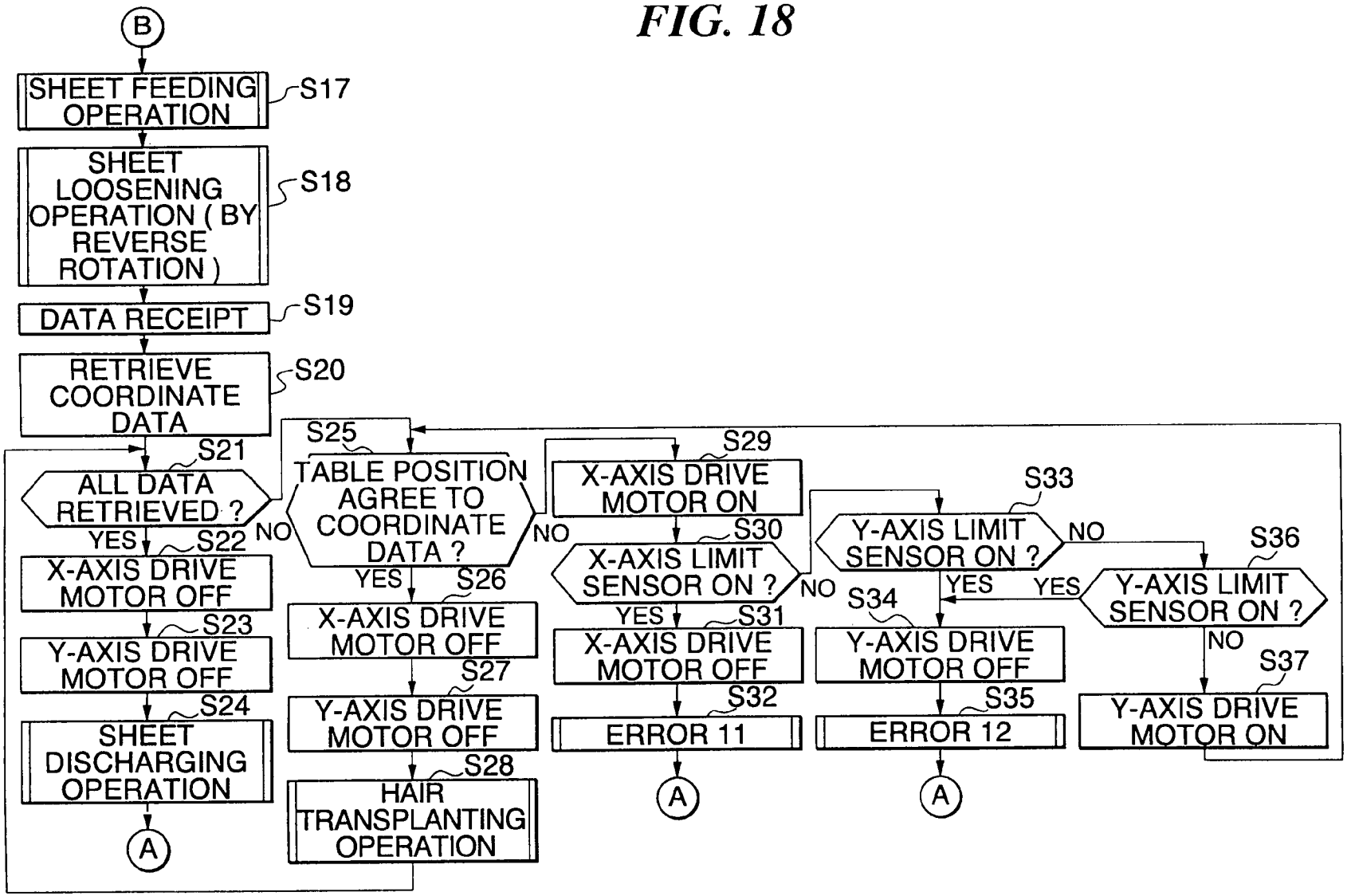
FIG. 18 is (a part of) a flowchart showing the method of manufacturing a wig in accordance with the present invention.
Figure 19:
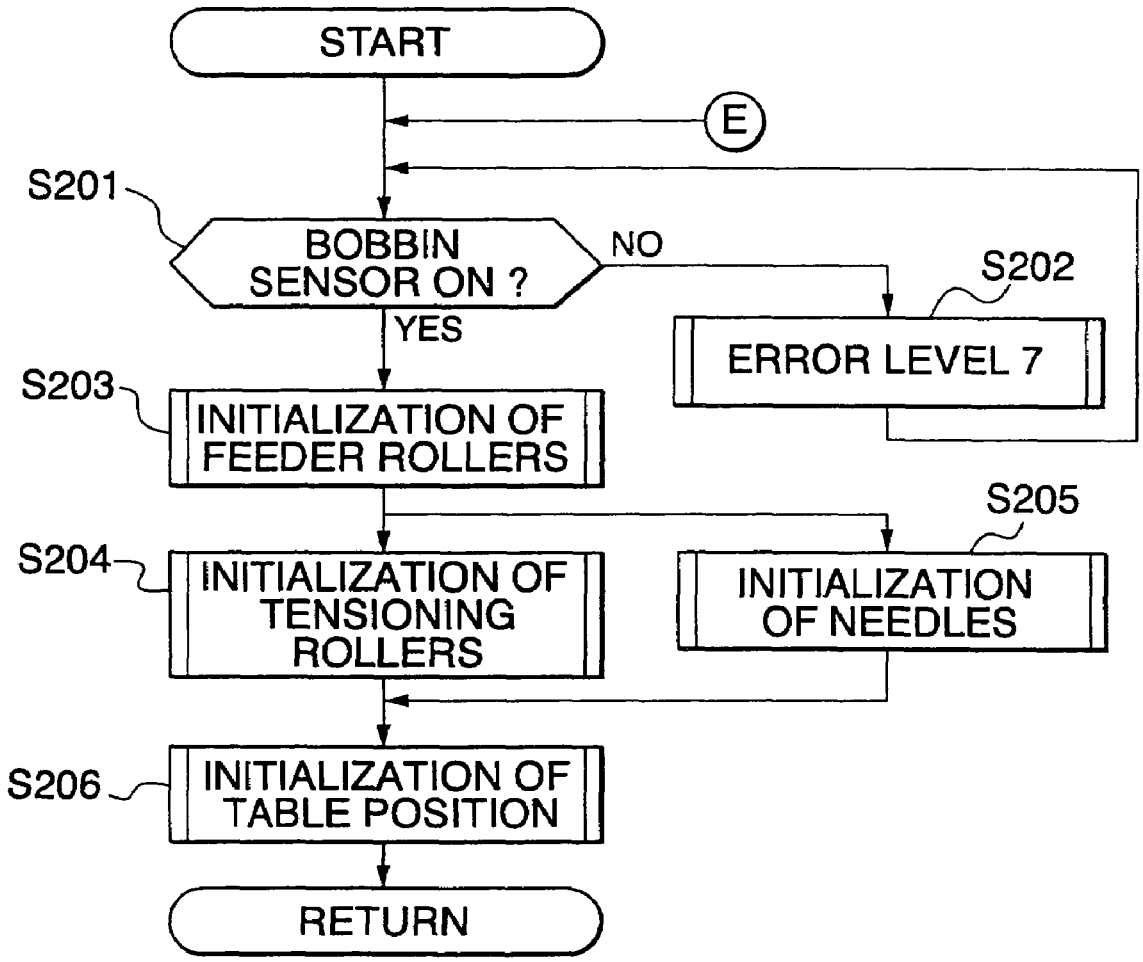
FIG. 19 is a flowchart showing respective unit initializing processes shown in FIGS. 16–18.

In FIGS. 16–18, the power source is turned on (S1) and the respective units are initialized (to be ready for starting operation) (S2). Then, a READY signal that notifies completion of initialization is supplied from each unit to the computer (S3). The computer then outputs an operation start signal. When receiving this signal (S4), the procedure goes to a step 5 (S5). If this signal is not received, the procedure is returned to the step 4 (S4). At the step 5 (S5), it is discriminated that there is a film sheet to be used as a base 11 between the sheet discharging rollers 28 at the discharge side. When there is the base 11, the sheet feeding process (S6) is carried out, which will be described in detail in reference to FIG. 30, and the sheet discharging process (S7) is carried out wherein the sheet discharging rollers 28 are driven to rotate in a forward direction, which will be described in detail in reference to FIG. 31. When there is no film sheet to be used as a base 11 at the discharge side, the computer determines that the apparatus is in an ERROR LEVEL 9 indicating no film sheet set (S8), and the procedure is returned to the step 5 (S5). Then, the tensioning motor 26*a* rotates in a forward or clockwise direction, the tensioning motor 26*b* rotates in a reverse direction, the tensioning motor 26*c* rotates in a forward direction and the tensioning motor 26*d* rotates in a reverse direction (S9*a*–S9*d*). It is then discriminated if cam sensors, not shown, are ON or not (S10*a*–S10*d*). When the cam sensor is ON, the corresponding tensioning motor 26*a*, 26*b*, 26*c*, 26*d* is turned off (S11*a*–S11*d*). When the cam sensor is not ON, the procedure is returned to S9*a*–S9*d*. Then, variables that determines the amount of rotation of the tensioning motors 26*a*, 26*b*, 26*c*, 26*d* are initialized (S12*a*–S12*d*), and It is discriminated if its value reaches a predetermined value (S13*a*–S13*d*). If YES, the tensioning motors 26*a*, 26*b*, 26*c*, 26*d* are caused to stop (S14*a*–S14*d*). If NO, the tensioning motor 26*a* rotates in a reverse direction, the tensioning motor 26*b* rotates forward, the tensioning motor 26*c* rotates reversely and the tensioning motor 26*d* rotates forward (S15*a*–S15*d*), and the amount of rotation of the respective tensioning motors 26*a*, 26*b*, 26*c*, 26*d* are count (S16*a*–S16*d*). By performing the processes through S9*a*, S9*b*, S9*c* and S9*d* to S14*a*, S14*b*, S14*c* and S14*d*, the sheet base 11 supplied onto the conveyor table 21 is nipped between the tensioning nip rollers 24, 25 and become stretched. Then, the sheet feeding process is carried out, which will be described in detail in reference to FIG. 30, wherein the sheet feeding rollers 27 becomes operative (S17). Then, the sheet discharging process is carried out, which will be described in detail in reference to FIG. 32, wherein the sheet discharging rollers 28 become operative (S18). Then, the prescribed data are received (S19), and the coordinate data are read out (S20). After the coordinate data have been read out (S21), the X-axis drive motor for the conveyor table 21 will stop (S22), and the Y-axis drive motor will also stop (S23). Then, the procedure advances to the discharging process (S24), which will be described in detail in reference to FIG. 33. If all the coordinate data have not yet been read out, the procedure advances to a step 25 (S25) where it is discriminated if the coordinate data designates predetermined position. If YES, the X-axis drive motor (not shown) for the conveyor table 21 is caused to stop (S26), and then the Y-axis drive motor is also caused to stop (S27). Thus, the positioning has been completed, and the procedure advances to the next, hair-transplanting process is to be carried out (S28). If the coordinate data position is NO, the X-axis drive motor for the conveyor table 21 is turned on (S29), and it is then discriminated if an X-axis limit sensor is ON or not (S30). If YES, the X-axis drive motor for the conveyor table 21 is caused to stop (S31). If there is an ERROR 11 (S32), the procedure is returned to S2. If the X-axis limit sensor is not ON, it is then discriminated if a Y-axis limit sensor is ON or not (S33). If it is ON, the Y-axis drive motor for the conveyor table 21 is caused to stop (S34). If there is an ERROR 12 (S35), which indicates that an X-axis H/P sensor and the X-axis drive motor should be out of order, the procedure is returned to S2. When the left-hand Y-axis limit sensor is not ON, it is then discriminated if the Y-axis limit sensor is ON or not (S36). If YES, the procedure advances to S34. If NO, the Y-axis drive motor for the conveyor table 21 is turned on (S37), and the procedure is returned to S25.

The initialization of the respective units (S2) will be described based on FIGS. 19–23. It is first discriminated if a sensor for detecting insertion of the artificial hairs 30 into the bobbins 31 is ON or not (S201). If the sensor is ON, the artificial hairs 30 of different colors reeled around the bobbins 31A, 31B, 31C and 31D are ready for starting operation, and the roller initialization is carried out, which will be described in detail in reference to FIG. 20 (S203). If the sensor is not ON, there is an ERROR LEVEL 7 indicating no insertion of the artificial hair 30 into the bobbin (S202), and the procedure is returned to S201. The tensioning rollers 23 in the tensioning/positioning unit 2 and the needle 41 in the hair-transplanting unit 4 are set to be ready for starting the respective operation (S204, S205). The conveyor table 21 is then set to be ready for its operation (S206).

Figure 20:
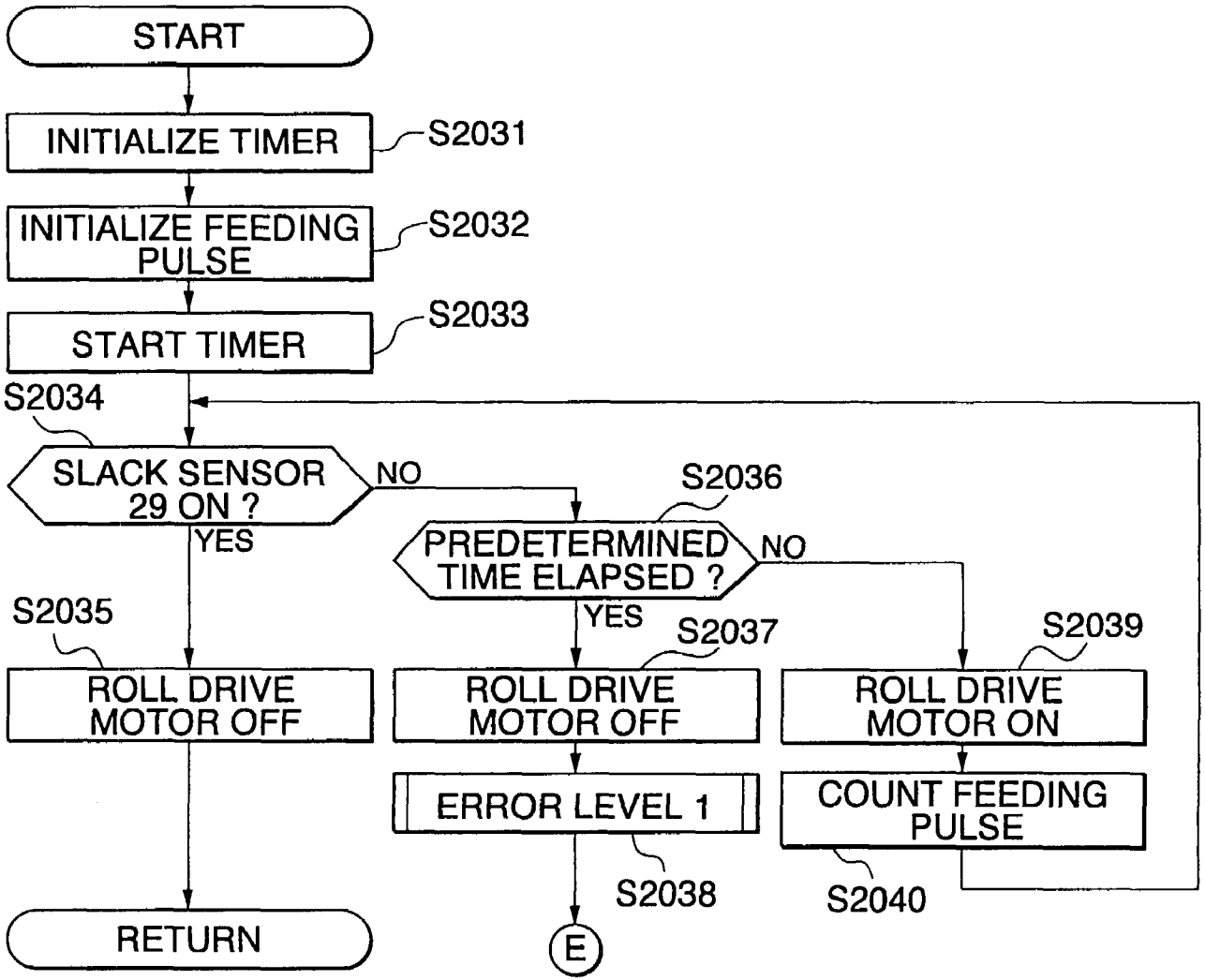
FIG. 20 is a flowchart showing a roller initializing process of FIG. 19.

The above-described roller initialization is shown in more detail in FIG. 20. A timer is first initialized (S2031) and the variation determining the amount of rotation of the sheet feeding rollers 27 that feeds a film sheet to be used as a base 11 is initialized (S2032). Then, the timer starts (S2033), and it is discriminated if the sheet slack sensor 29 is ON or not (S2034). If YES, the drive motor for the sheet feeding rollers 27 is turned off (S2035), and the procedure is returned. If NO at S2034, it is then discriminated if the timer reaches to a predetermined count (S2036). If YES, the drive motor for the sheet feeding rollers 27 is turned off (S2037). When there arises an ERROR LEVEL 1 indicating no film sheet for use as a base 11 (S2038), the procedure is returned to S201. If the timer does not reach the predetermined count, the drive motor for the sheet feeding rollers 27 is turned on (S2039), the amount of rotation of the sheet feeding rollers 27 is count (S2040), and the procedure is returned to S2034.

Figure 21:
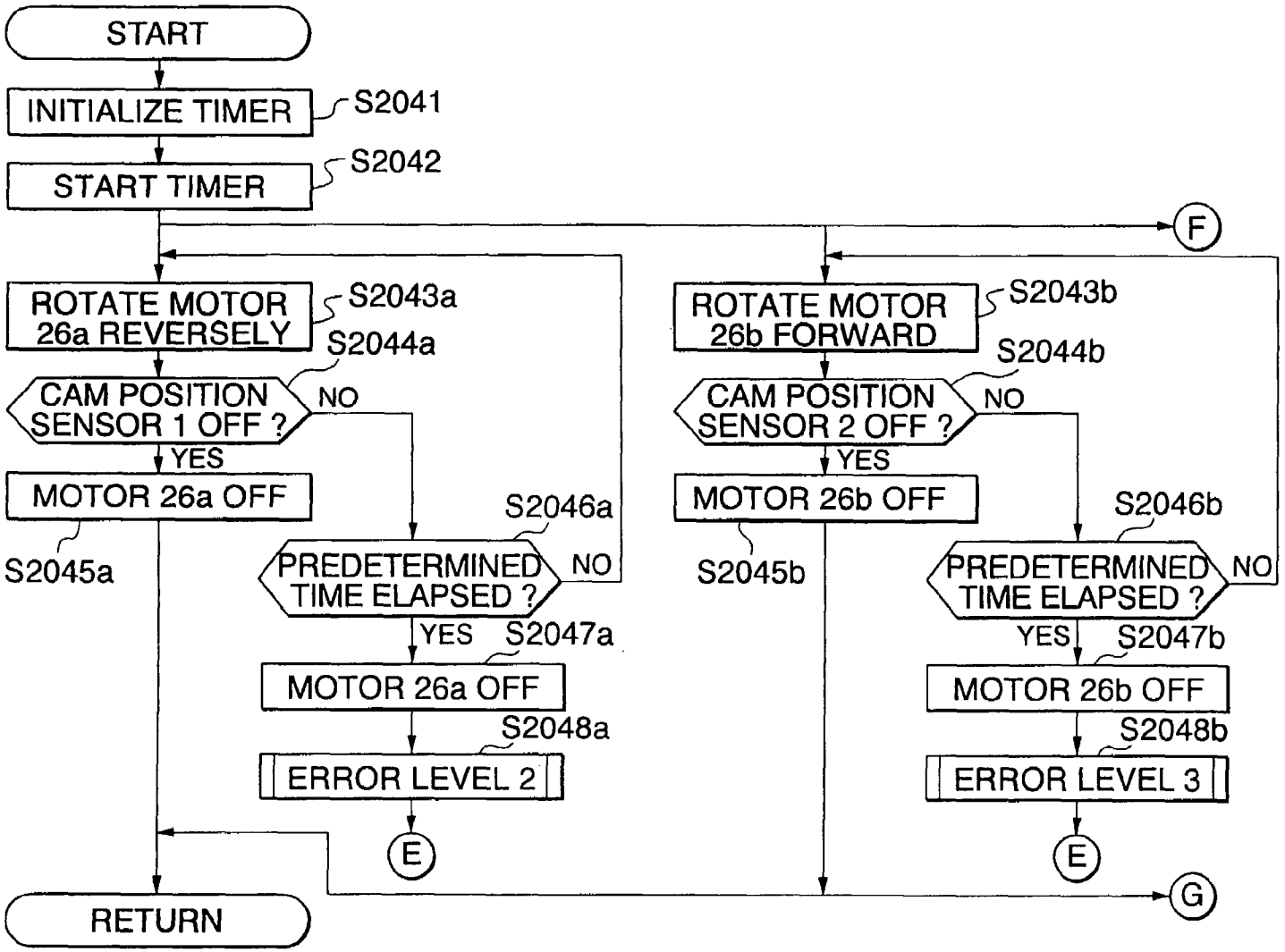
FIG. 21 is (a part of) a flowchart showing a tensioner initializing process of FIG. 19.
Figure 22:
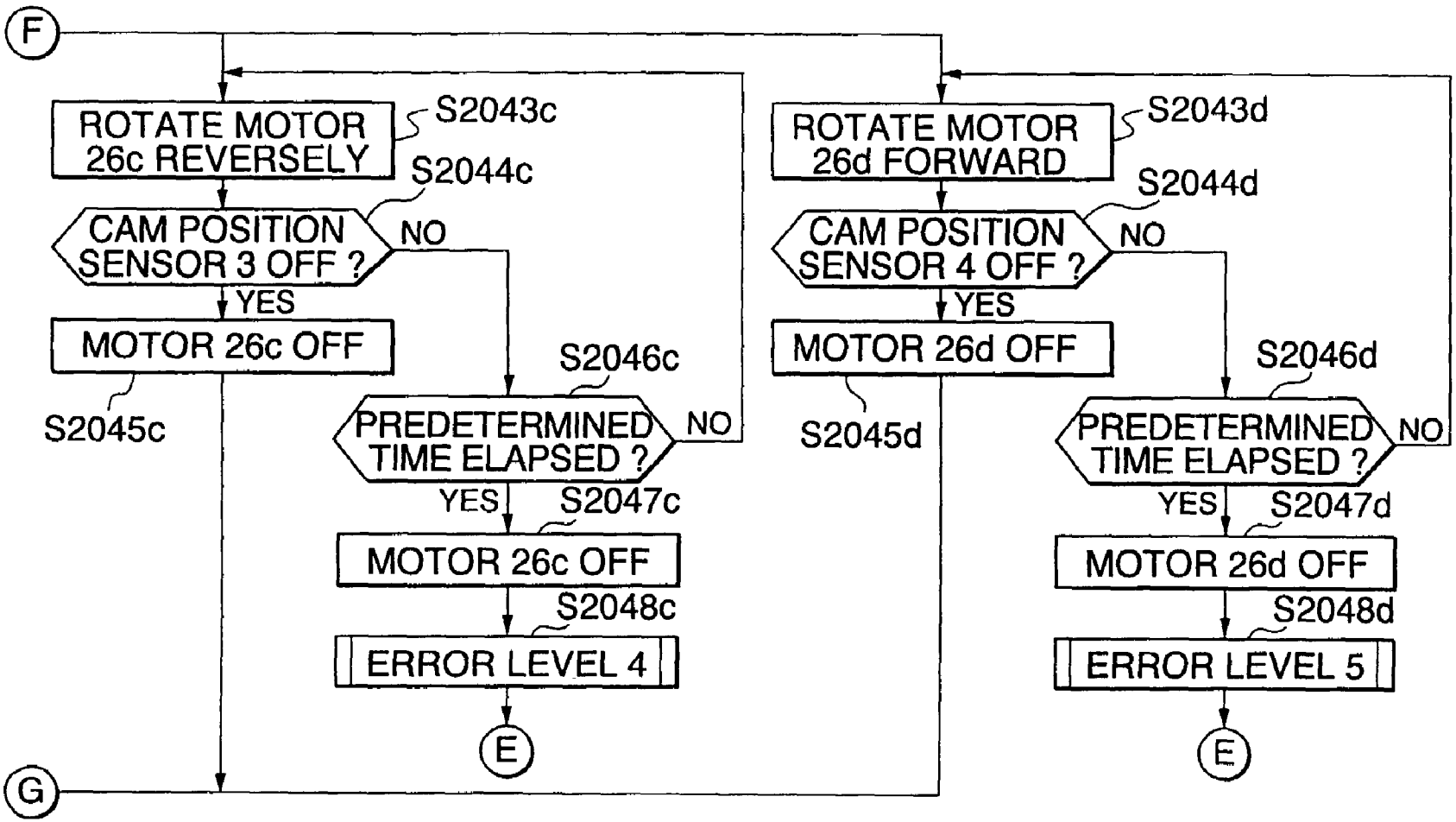
FIG. 22 is (a part of) a flowchart showing the tensioner initializing process of FIG. 19.

The tensioner initialization will be described in more detail based on FIG. 21 and FIG. 22. The timer is first itialized (S2041) and then caused to start (S2042). The tensioning motor 26*a* rotates in a reverse direction, the tensioning motor 26*b* rotates forward, the tensioning motor 26*c* rotates reversely and the tensioning motor 26*d* rotates forward (S2043*a*–S2043*d*). It is then discriminated if the cam position sensors, not shown, are ON or not (S2044*a*–S2044*d*). If YES, the corresponding tensioning motor 26*a*, 26*b*, 26*c*, 26*d* will stop (S2045*a*–S2045*d*), and the procedure is returned. If NO at S2044*a*–S2044*d*, it is then discriminated if the timer has reached a predetermined count (S2046*a*–S2046*d*). If YES, the corresponding tensioning motor 26*a*, 26*b*, 26*c*, 26*d* stops (S2047*a*–S2047*d*). If there is an ERROR LEVEL 2, 3, 4 or 5 (S2048*a*–S2048*d*), which indicates that the tensioning roller 23 is out of order, the procedure is returned to S201. If NO at S2046*a*–S2046*d*, the procedure is returned to S2043*a*–S2043*d*.

Figure 23:
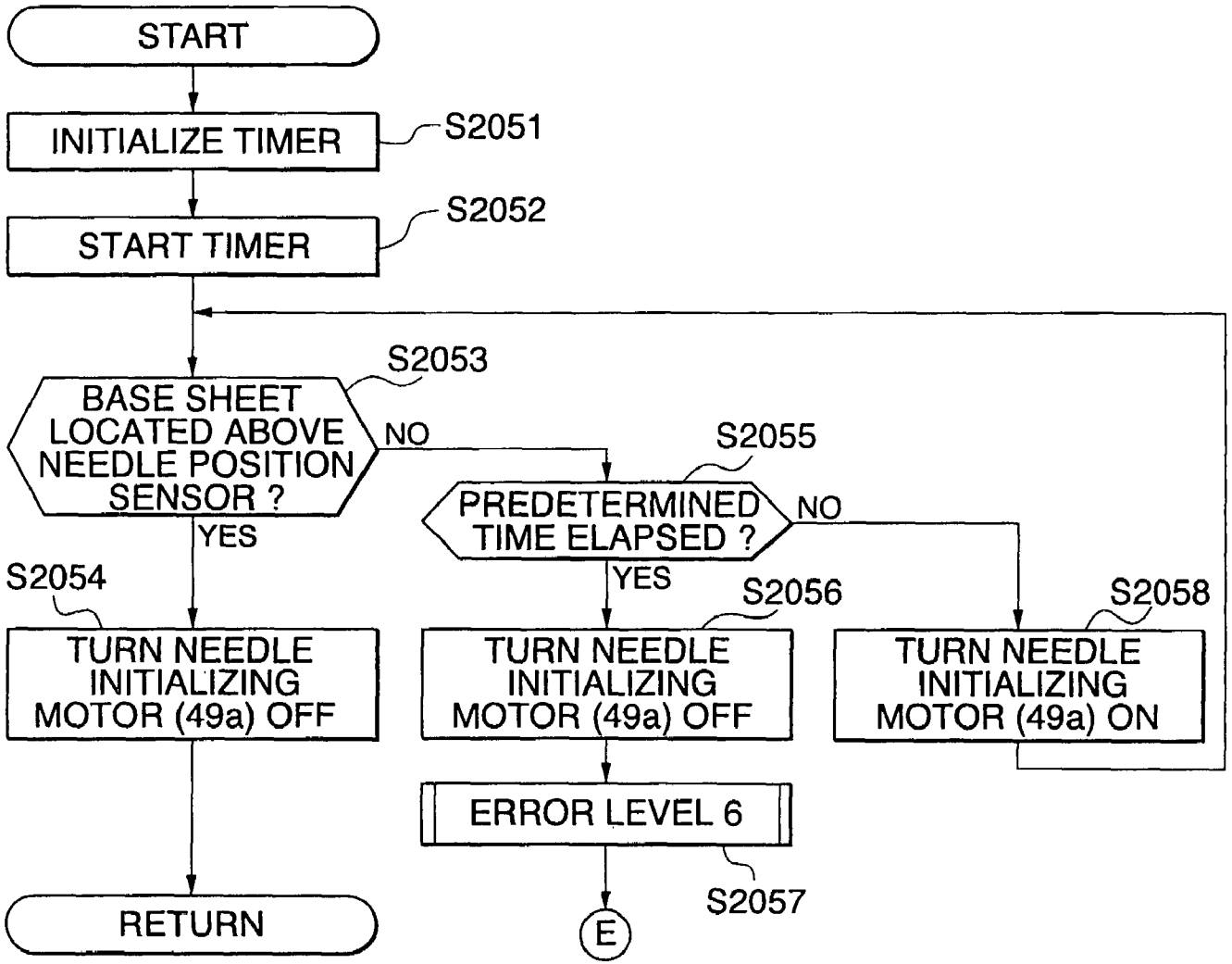
FIG. 23 is a flowchart showing a needle initializing process of FIG. 19.

The needle initialization is shown in more detail in FIG. 23. The timer is first initialized (S2051) and then caused to start (S2052). It is then discriminated if there is a film sheet for use as a base 11 above a needle position sensor, not shown (S2053). If YES, a motor 49*a* for initialization of the needle 41 stops (S2054), and the procedure is returned. If NO at S2053, it is discriminated if the timer has reached a predetermined count (S2055). If YES, the motor 49*a* for initialization of the needle 41 stops (S2056). When there is an ERROR LEVEL 6 indicating that the needle unit would be out of order, the procedure is returned to S201. When the timer has not yet reached a predetermined count, the motor 49*a* for initialization of the needle 41 is turned on (S2058), and the procedure is returned to S2053.

Figure 24:
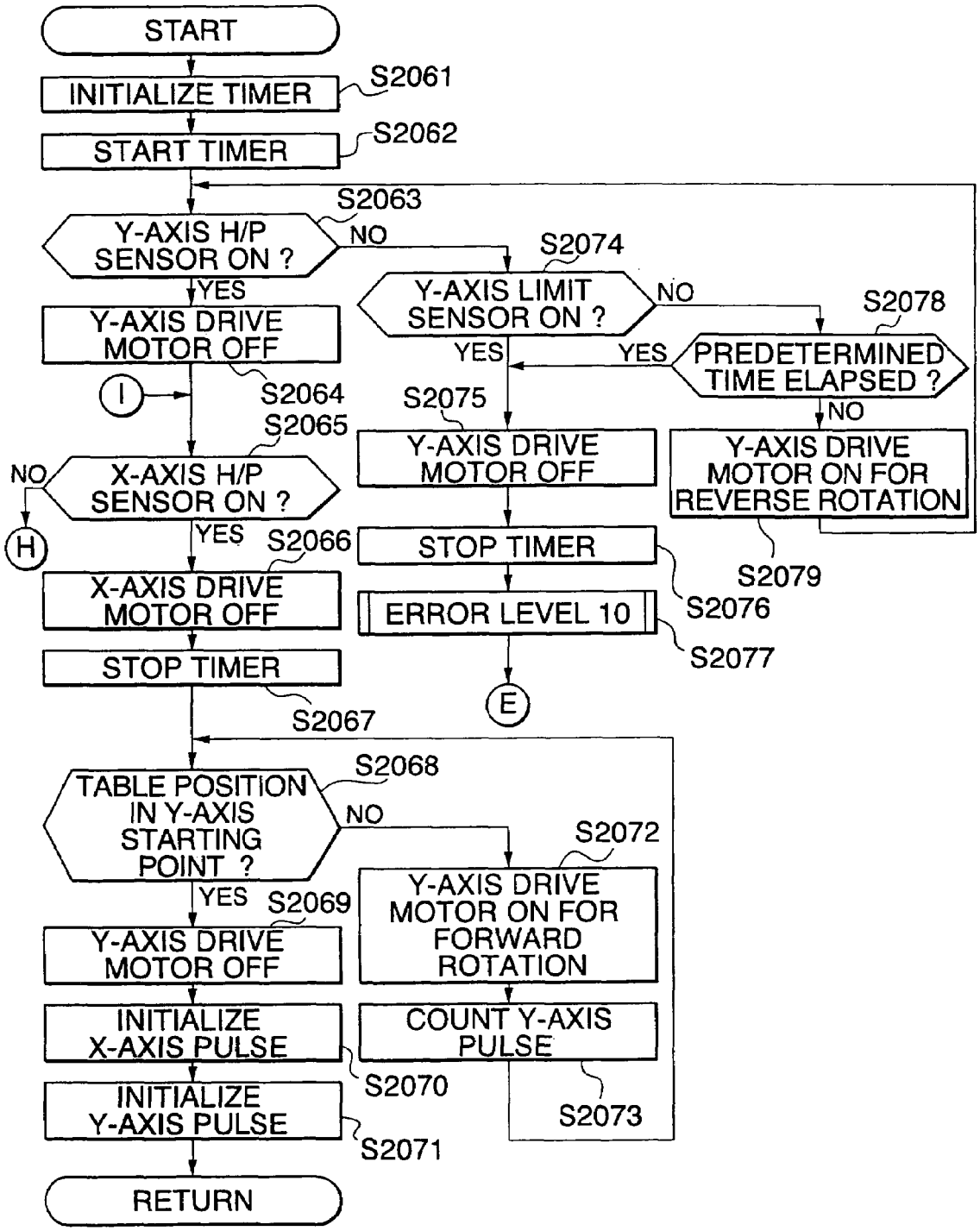
FIG. 24 is (a part of) a flowchart showing a conveyor table initializing process of FIG. 19.
Figure 25:
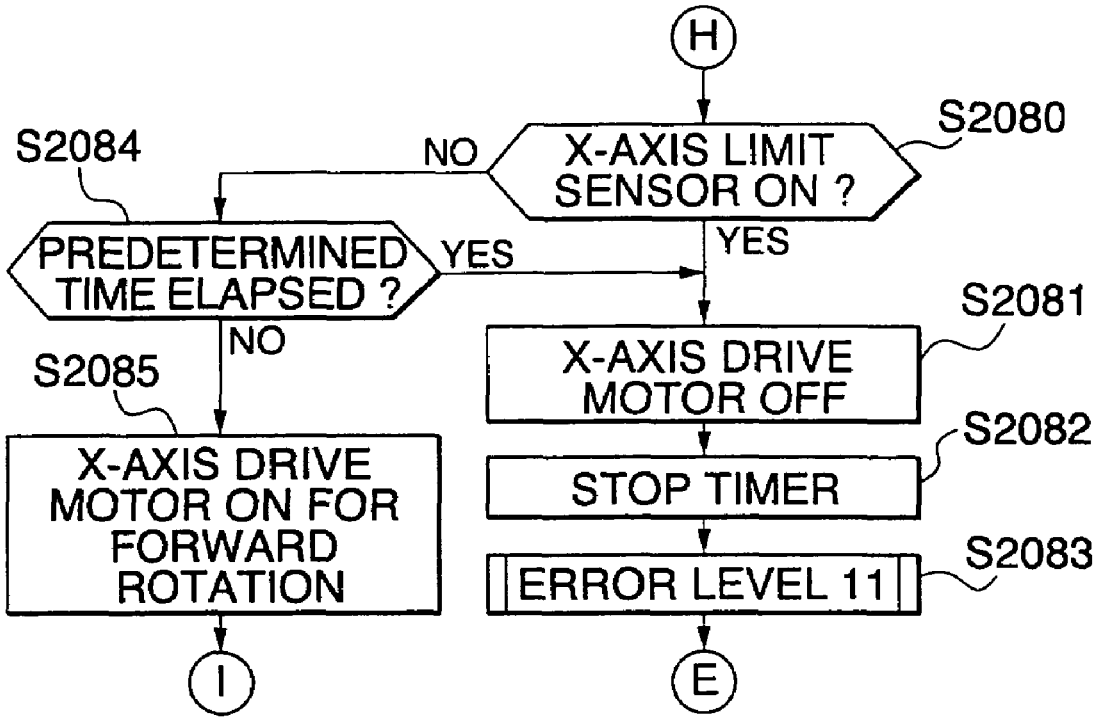
FIG. 25 is (a part of) a flowchart showing the conveyor table initializing process of FIG. 19.

The conveyor table initialization is shown in more detail in FIG. 24 and FIG. 25. The timer is initialized (S2061) and caused to start (S2062). It is then discriminated if a Y-axis H/P sensor for detecting the origin along Y-axis is ON or not (S2063). If YES, the Y-axis drive motor for the conveyor table 21 is turned off (S2064). Next, it is discriminated if the X-axis H/P sensor for detecting the origin along X-axis is ON or not (S2065). If YES, the X-axis drive motor for the conveyor table 21 is turned off (S2066), and the timer stops (S2067). It is then discriminated if the table position agrees with the origin on the Y-axis at which the hair-transplantation should start (S2068). If YES, the Y-axis drive motor for the conveyor table 21 is turned off (S2069). The variation determining the amount of movement along the X-axis is initialized (S2070) and then the variation determining the amount of movement along the Y-axis is initialized (S2071), and the procedure is returned. If NO at S2068, the Y-axis drive motor for the conveyor table 21 is turned on to rotate in a forward direction (S2072). The amount of movement along the Y-axis is count (S2073), and the procedure is returned to S2068.

If No at S2063, the procedure advances to S2074 where it is discriminated if the Y-axis limit sensor is ON or not. If YES, the Y-axis drive motor for the conveyor table 21 is turned off (S2075), and the timer also stops (S2076). When there arises an ERROR LEVEL 10 (S2077), indicating that the Y-axis H/P sensor and the Y-axis drive motor are both out of order, the procedure is returned to S201. If NO at S2074, it is then discriminated if the timer has reached a predetermined count (S2078). If YES, the procedure advances to S2075, whereas if NO, the Y-axis drive motor for the conveyor table 21 rotates in a reverse direction (S2079), and the procedure is returned to S2063.

If No at S2065, it is then discriminated if the X-axis limit sensor is ON or not (S2080). If YES, the X-axis drive motor for the conveyor table 21 is turned off (S2081), and the timer stops (S2082). When there arises an ERROR LEVEL 11 indicating malfunction (S2083), the procedure is returned to S201. If NO at S2080, it is then discriminated if the timer has reached a predetermined count (S2084). If YES, the procedure advances to S2081. If NO, the X-axis drive motor on the conveyor table 21 is turned on to rotate in a forward direction (S2085), and the procedure is returned to S2065.

Figure 26:
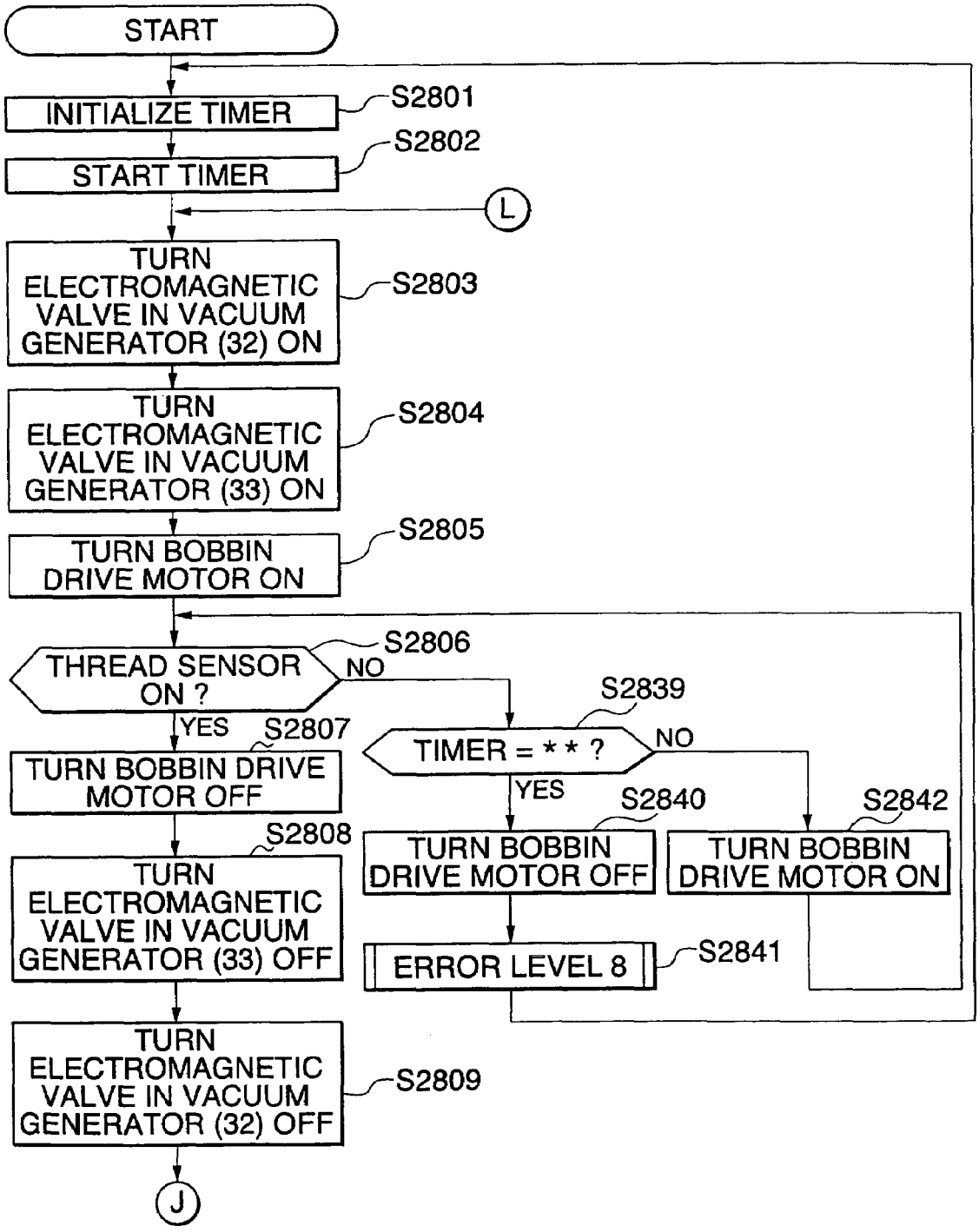
FIG. 26 is (a part of) a flowchart showing a hair-transplanting process of FIGS. 16–18.
Figure 27:
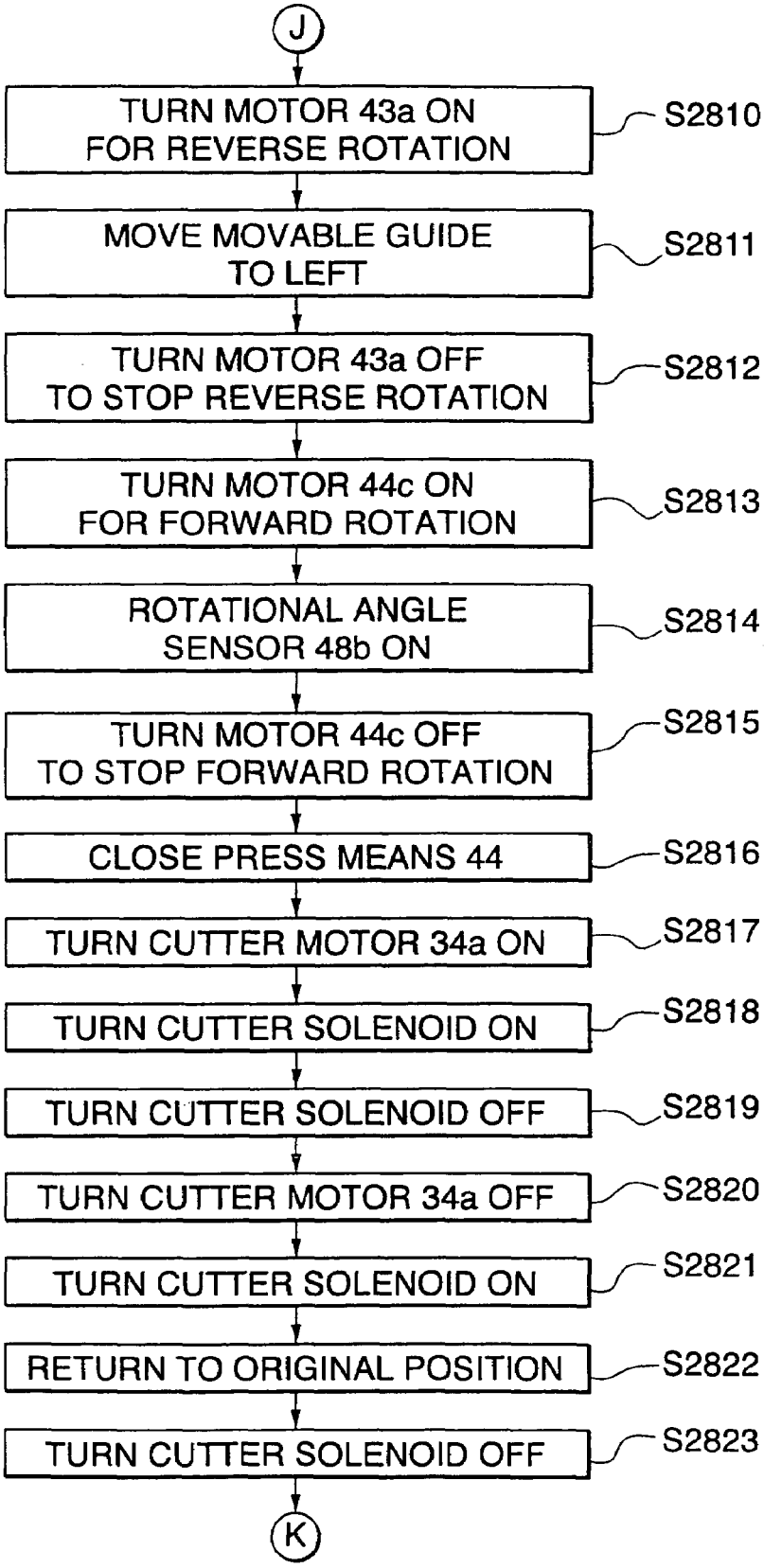
FIG. 27 is (a part of) a flowchart showing the hair-transplanting process of FIGS. 16–18.
Figure 28:
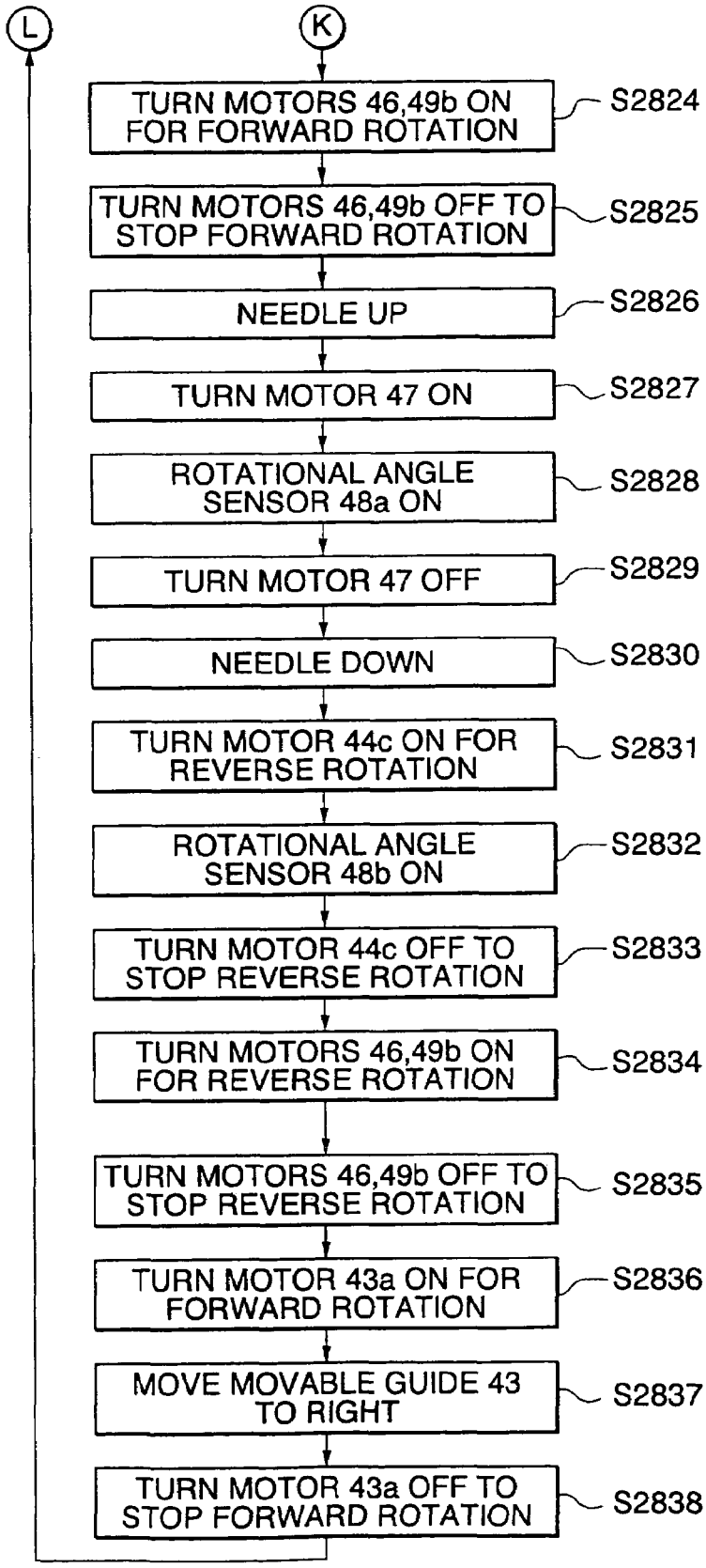
FIG. 28 is (a part of) a flowchart showing the hair-transplanting process of FIGS. 16–18.

The hair-transplantation of the artificial hair 30 will now be described in reference to FIGS. 26–28. The timer is initialized (S2801) and caused to start (S2802). The electromagnetic valve in the vacuum generator 32 is turned on (S2803), and the electromagnetic valve in the vacuum generator 33 is also turned on (S2804). Then, the drive motor for the selected bobbin is turned on so that the artificial hair 30 is supplied therefrom (S2805) to pass through the movable guide 43. It is then discriminated if the thread sensor for detecting the artificial hair 30 of a predetermined length is ON or not (S2806). If YES, a motor (not shown) for driving the selected bobbin 31 is turned off (S2807). The electromagnetic valve in the vacuum generator 33 is turned off (S2808) and the electromagnetic valve in the vacuum generator 32 is turned off (S2809). The motor 43*a* for driving the movable guide 43 is turned on to rotate in a reverse direction (S2810) to rotate the movable guide 43 to move to left (S2811–S2812). Once the movable guide 43 reaches the left-end position, the reverse rotation of the motor 43*a* is turned off by the limit switch (not shown). At the same time, the motor 44*c* rotates over a predetermined angle (S2813–S2815) to close the press means 44, 45 to hold the artificial hair 30 therebetween (S2816). Then, the cutter motor 34*a* is driven (S2817). The cutter solenoid is turned on to move the cutter 34 into the gap G1 (S2818). After the cutter solenoid has been turned off (S1819), the cutter motor 34*a* stops (S2820) so that the artificial hair 30 is cut by the cutter 34 into a predetermined length. Then, the cutter solenoid is turned on to return its original position (S2821–S2822), and then turned off (S2823). Then, the motors 46, 49*b* rotates forward to horizontally rotate the head 42 and the needle 41 (S2824–S2825), followed by the needle elevation (S2826) that will be described in detail in reference to FIG. 28. Then, the motor 47 rotates over a predetermined angle to rotate the press means 44 toward the needle 41 (S2827–S2829), followed by the needle descent (S2830) that will be described in detail in reference to FIG. 29. In the needle descending step, the needle 41 goes down with the artificial hair 30 being entrapped by the groove 41'. Immediately after (or almost at the same time when) the needle-descending step, the motor 44*c* starts to rotate reversely to open the movable member 44*a* (S2831–S2833). This allows the artificial hair 30 to be pulled down. Then, the motors 46, 49*b* rotates reversely on a horizontal plane to be returned to their original positions (S2834–S2835). Then, the motor 43*a* for driving the movable guide 43 is turned on to rotate forward (S2836) to move the movable guide 43 to right (S2837). This connects the movable guide 43 with the artificial hair supply nozzle 37, and the forward rotation of the motor 43*a* is turned off (S2838). The procedure is then returned to S2803 and, after movement along X-axis and Y-axis over predetermined pitches, respectively, the above-described transplanting operation of the artificial hair 30 will be repeated. If NO at S2806, it is discriminated if the timer has reached a set value (S2839). If YES, the motors for driving the respective bobbins 31 will stop (S2840). If there arises an ERROR LEVEL 8 indicating no artificial hair 30 around bobbin 31, a stopped-up condition with hairs or sensor malfunction (S2841), the procedure is returned to S2801. If the count has not yet reached the set value at S2839, the motors for driving the respective bobbins 31 are driven (S2842), and the procedure is returned to S2806.

Figure 29B:
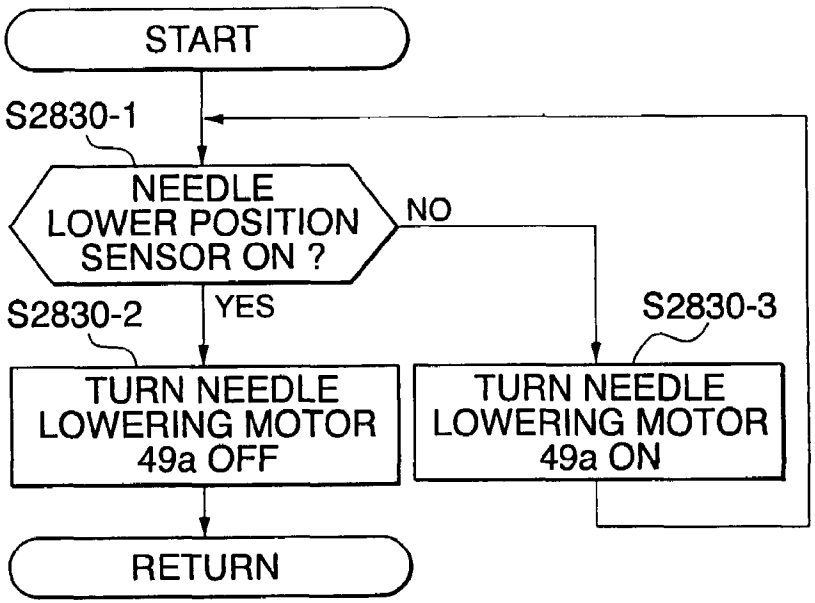
FIG. 29(A) is a flowchart showing a needle elevating process of FIGS. 26–28 and FIG. 29(B) is a flowchart showing a needle descending process.
Figure 29A:
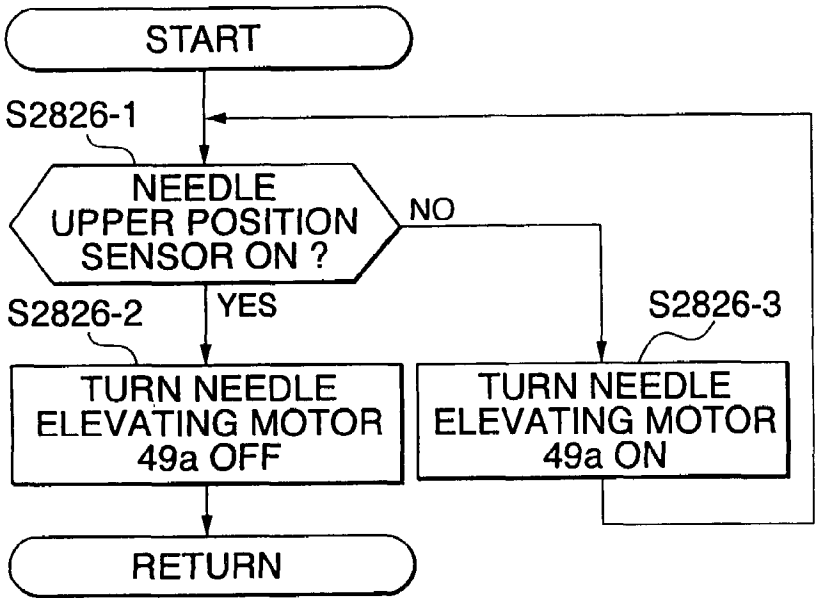

The needle-elevating step at S2826 will be described in more detail based on FIG. 29(A). It is first discriminated if the needle position sensor, not shown, detects that the needle is in the upper position (S2826-1). If YES, rotation of the motor 49*a* for elevating the needle 41 comes to a stop (S2826-2), and the procedure is returned. If NO, rotation of the motor 49*a* for elevating the needle 41 is turned on (S2826-3), and the procedure is returned to S2826-1.

The needle-descending step at S2830 will be described in more detail based on FIG. 29(B). It is first discriminated if the needle position sensor, not shown, detects that the needle is in the lower position (S2830-1). If YES, rotation of the motor 49*a* for lowering the needle 41 comes to a stop (S2830-2), and the procedure is returned. If NO, rotation of the motor 49*a* for lowering the needle 41 is turned on (S2830-3), and the procedure is returned to S2830-1.

Figure 30:
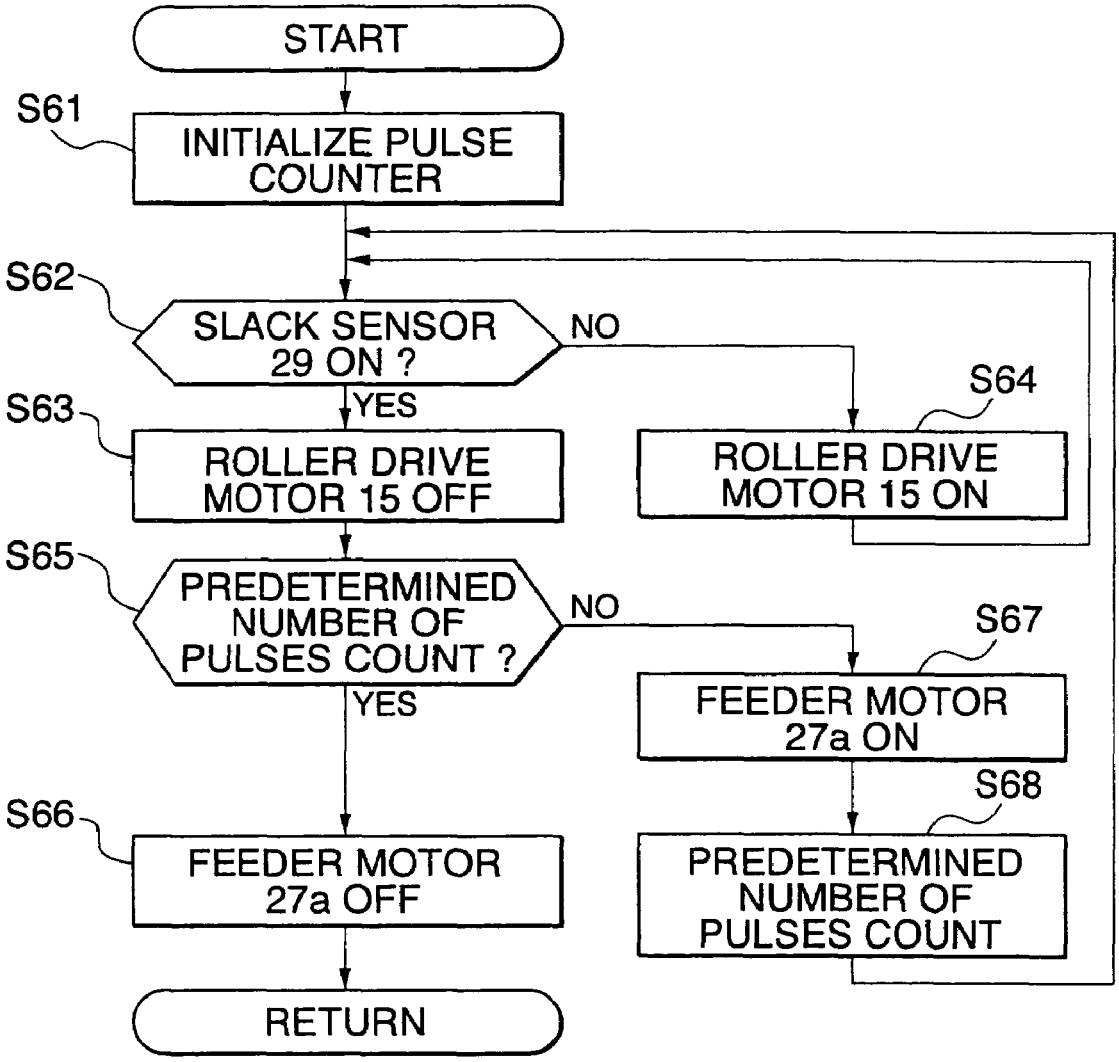
FIG. 30 is a flowchart showing a sheet feeding process of FIGS. 16–18.

The sheet-feeding step at S6 will be described in more detail based on FIG. 30. After the variation for determining the amount of rotation of the feeder rollers 27 is initialized (S61), it is discriminated if the slack sensor 29 is ON or not (S62). If YES, the roller drive motor 15 in the base supply unit 1 is turned off (S63). If NO, the said roller drive motor 15 is turned on (S64), and the procedure is returned to S62. It is then discriminated if the sheet feeding rollers 27 has been rotated over a predetermined unreel period (S65). If YES, the sheet feeding motor 27*a* for driving the sheet feeding rollers 27 is turned off (S66), and the procedure is returned. If NO at S65, the sheet feeding motor 27*a* is turned on (S67), the amount of rotation of the sheet feeding rollers 27 is count by a pulse counter (S68), and the procedure is then returned to S62.

Figure 31:
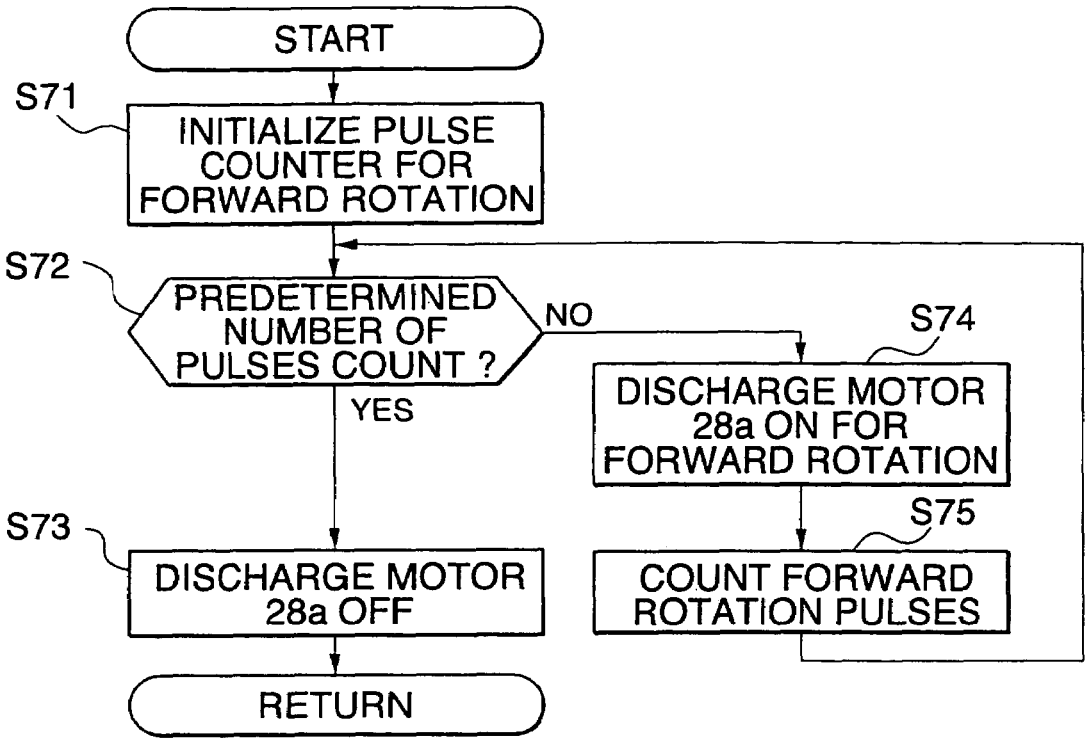
FIG. 31 is a flowchart showing a sheet discharging process (by forward rotation) of FIGS. 16–18.

The sheet discharging operation at S7 wherein the sheet discharging rollers 28 rotate forward will be described in more detail based on FIG. 31. The count value indicating the number of forward rotation of the sheet discharging rollers 28 is initialized (S71). It is then discriminated if the number of forward rotation of the sheet discharging rollers 28 has reached a predetermined number (S72). If YES, the drive motor 28*a* for the sheet discharging rollers 28 is turned off (S73), and the procedure is returned. If NO at S72, the drive motor 28*a* for the sheet discharging rollers 28 is driven forward (S74), and the number of forward rotation thereof is count (S75). The procedure is then returned to S72. Thus, the operation shown in FIGS. 9(A)–9(C) has been carried out.

Figure 32:
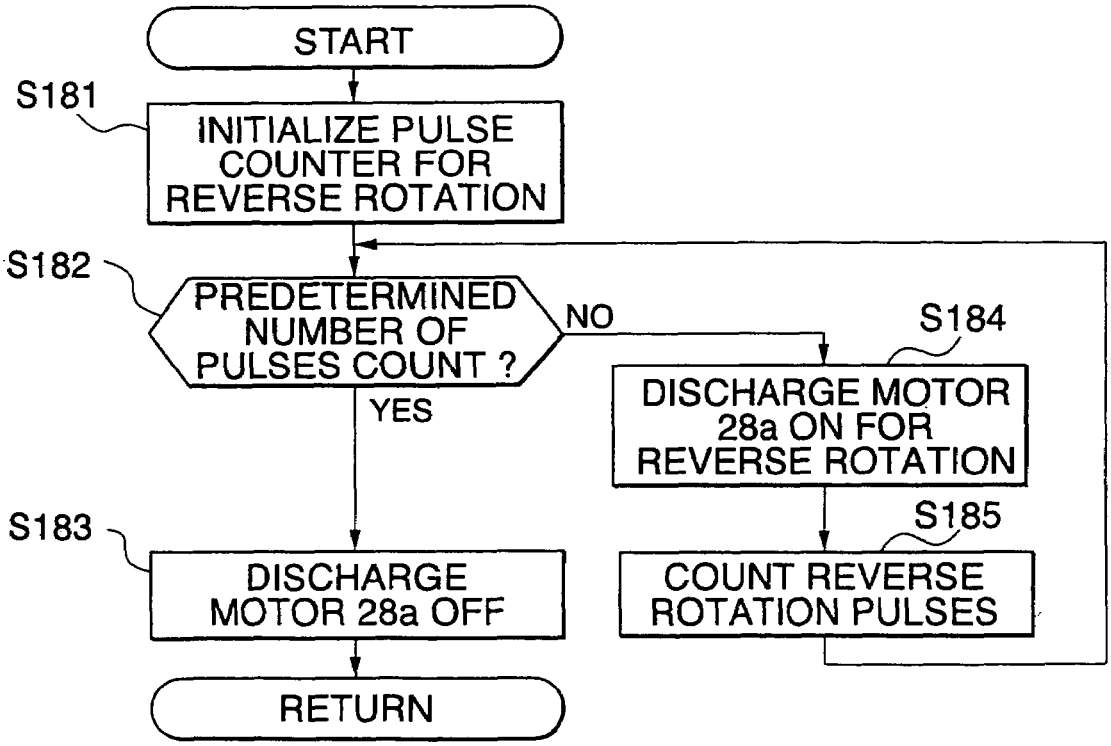
FIG. 32 is a flowchart showing a sheet discharging process (by reverse rotation) of FIGS. 16–18.

The sheet-discharging step at S18 wherein the sheet discharging rollers 28 rotate reversely will be described in more detail based on FIG. 32. The count value indicating the number of reverse rotation of the sheet discharging rollers 28 is initialized (S181). It is then discriminated if the number of reverse rotation of the sheet discharging rollers 28 has reached a predetermined number (S182). If YES, the drive motor 28*a* for the sheet discharging rollers 28 is turned off (S183), and the procedure is returned. If NO at S182, the drive motor 28*a* for the sheet discharging rollers 28 is driven reversely (S184), and the number of reverse rotation thereof is count (S185). The procedure is then returned to S182. Thus, the operation shown in FIG. 9(D) has been carried out.

Figure 33:
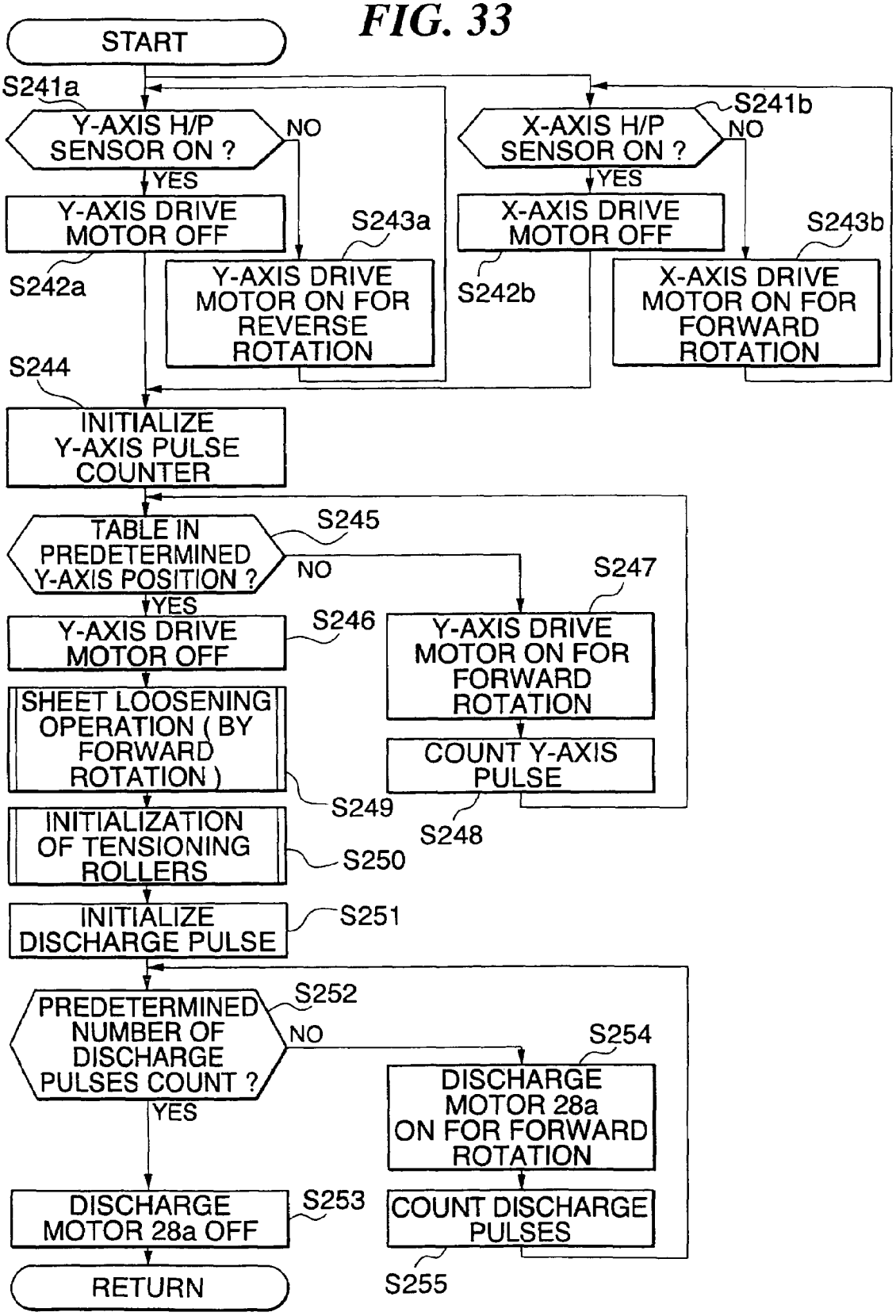
FIG. 33 is a flowchart showing a discharge process of FIGS. 16–18.

The sheet-discharging step at S24 will be described in more detail based on FIG. 33. At first, it is discriminated if the Y-axis H/P sensor is ON or not and if the X-axis H/P sensor are ON or not (S241*a*, S241*b*). If YES, the Y-axis drive motor for the conveyor table 21 is turned off (S242*a*), and the X-axis drive motor for the conveyor table 21 is also turned off (S242*b*). If NO, the Y-axis drive motor on the conveyor table 21 is driven to rotate reversely (S243*a*), and the procedure is returned to S241*a*. Likewise, the X-axis drive motor for the conveyor table 21 is driven to rotate forward (S243*b*), and the procedure is returned to S241*b*. The pulse counter is then initialized so that the amount of movement along the Y-axis is set to zero (S244). It is then discriminated if the amount of movement along the Y-axis has reached a predetermined position (S245). If YES, the Y-axis drive motor for the conveyor table 21 is turned off (S246). If NO, the Y-axis drive motor for the conveyor table 21 is driven to rotate forward (S247), and the amount of forward movement is count (S248). The procedure is then returned to S245. The procedure then advances to the sheet-discharging step (FIG. 31) (S249), followed by the tensioner initialization (FIG. 21 and FIG. 22) (S250). Then, the amount of rotation of the sheet discharging rollers 28 is initialized (S251), and it is discriminated if it reaches a predetermined amount (S252). If YES, the sheet discharging motor 28*a* for driving the discharge rollers 28 is turned off (S253), and the procedure is returned. If NO at S252, the sheet discharging motor 28*a* is driven to rotate forward (S254), the amount of movement at the discharge end is count (S255), and the procedure is returned to S252.

The following advantages and effects may be achieved in accordance with the above-mentioned embodiment. First, relationship between width (W) of the needle 41 and the transplanting pitch (P) may be interrupted. More particularly, the pitch of natural human hairs is less than 1 mm, usually approximately 0.5 mm. Therefore, it is desirable that a wig has an equivalent hair-transplanting pitch (P) of less than 1 mm, or of the order of 0.5 mm. In order to provide a hair-transplanting pitch (P) of approximately 0.5 mm, the needle width should be much shorter than 0.5 mm, otherwise needle holes in the base produced by needle penetration would become a continuous slit, which makes hair-transplantation impossible. However, according to the currently available technology and materials, the width (W) of the needle 41 should be approximately 1 mm or larger. If the width (W) of the needle 41 should be reduced to about 0.5 mm, the needle tends to cause some trouble such as breakage or deformation.

In accordance with the present invention, the base made from an elastic sheet can be stretched when subjected to tension. Since the pitch (P) (that is 2 mm in the embodiment) is larger than the width (W) of the needle 41 (that is 1 mm in the embodiment) in a direction perpendicular to the feeding direction of the artificial hair 30 that is fed onto the stretched base 11, the needle holes formed by transplantation can not be transformed into a continuous groove. Further, even when the transplantation pitch (P) is determined as a double of the needle width (W), when the stretched condition of the base 11 is released after the transplanting operation is completed, the base 11 will shrink so that the transplantation pitch (P) is decreased to substantially a half (to be approximately 0.5 mm in the embodiment), which means that a favorable pitch (P) may be obtained. This enables mechanization, which makes it possible to manufacture wigs in a reduced time and prevent inferior products. In addition the base 11 has good breathability, thereby preventing a sweaty condition in a wig when it is worn on a head or other human body part.

The artificial hair 30 once transplanted is blown away by the blowing unit 5 in a direction opposite to the needle 41, which assures that the artificial hair 30 may be transplanted onto a surface having no obstacles. Accordingly, the artificial hair 30 that has been transplanted and the next artificial hair 30 could not get entangled with each other, so that he transplanting operation can be achieved smoothly.

Because the base 11 is very thin, post-processing after the hair-transplanting process A may be done freely and have wide application. FIG. 1 illustrates an application where a three-dimensional wig is manufactured in accordance with the present invention. The discharged base 11 is subjected to the first adhesive applying process B. A first glue applicator 6 provides first glue 61 for securing the artificial hairs 30 that have been transplanted onto the top surface of the base 11. More specifically, the first glue applicator 6 comprises a tank 62, the first glue 61 in the tank 62, and a nozzle device 63 driven by the air compressor 39 to jet the first glue 61. At the hair-transplanting process A, it jets the first glue 61 toward the base end portions 30*a* (shown in FIG. 8) of the artificial hairs 30 remaining on the top surface of the base 11 onto which the artificial hairs 30 have been transplanted, thereby securing the base end portions 30*a* onto the base 11. The first glue 61 is of a quick-drying nature and contains a hardening agent for bearing heat and pressure applied at the forming process D to be described later.

Then, the cutting process C will be carried out. Here, the base 11 to which the first glue 61 has been applied is cut by the cutter unit 7 comprising the cutter device 71 into a predetermined shape.

Then, the forming process D will be carried out. Here, the base 11 thus cut by a forming unit 8 is subjected to heat and pressure to be formed into a predetermined shape. The forming unit 8 has, for example, a three-dimensional forming cavity 81 corresponding to a head size, and the base 11 is transformed in conformity to the forming cavity 81. The forming cavity 81 is divided into right and left halves, each having a pair of upper and lower teeth.

Then, the second adhesive applying process E will be carried out. Here, a second glue applicator 9 applies second glue 91 onto the top surface of the base 11. More specifically, the second glue applicator 9 comprises a tank 92, the second glue 91 in the tank 92, and a nozzle device 93 driven by the air compressor 39 to jet the second glue 91. It jets the second glue 91 onto the first glue 61 that has been hardened, to form an adhesive layer (not shown) of the wig. The second glue 91 is of an adhesive nature that is fittable to the human skin, which may be one for medical use. Thus, the wig is completely manufactured and may be directly attached to the head.

The length of the artificial hair 30 is not limited, not like the human hair, and may be supplied as an endless, continuous one. Accordingly, when the artificial hair 30 in an amount corresponding to the estimated amount of daily work consumption is supplied to the rollers, the work may be done continuously, without interruption, which further contributes to improvement of efficiency.

Since the artificial hairs 30 may have different colors and different materials, a special wig such as one streaked with grizzled hair, one being well resistant to water and moisture, etc. may conveniently and easily be manufactured. When manufacturing a wig streaked with grizzled hair, it may be possible to control at will proportion of gray and black hairs which may differ at different sites.

Since movement of the conveyor table 21 and the needle 41 is controlled by the control unit such as a computer, the manner or mode of transplanting the artificial hairs 30 onto the base 11 may be not only a straight stitching but also a zigzag stitching that provides more resistant to separation after transplanting.

The present invention is not limited to the embodiments that have been described hereinabove and should be understood to have various variations and modifications without departing from the spirits and scope of the invention defined in the appended claims. For example, a degree of tension applied to the base 11 is variable depending upon stretchability of material of the base 11, by which the transplanting pitch (P) may be determined upon demand.

Although the base 11 is supplied in a horizontal orientation in the foregoing embodiment, it may be supplied in a vertical orientation. It may also be supplied in a slanting orientation.

The kinds and number of bobbins 31 may be optional.

The material of the base 11 preferably comprises nonwoven made of synthetic resin fiber or a breathable film, but they are not limitative. It may be made from animal fiber, vegetable fiber, mineral fiber, etc. It may be woven material, as well. The material and kind is not at all limited, as far as it has stretchability.

The transplantation of the artificial hair 30 onto the base 11 may be done in a slanting direction.

The length of the artificial hair 30 may be varied at will in accordance with a design determined and controlled by the computer.

Means for feeding the artificial hair 30 into the conduit 35 may be one other than the vacuum generator.

One or plurality of the artificial hair 30 may be supplied.

The hair-transplanted wig, that is flat because not subjected to the forming process D shown in FIG. 1, may be shipped as a final product.

Because the base 11 is very thin in the wig manufactured in accordance with the present invention, it is applicable not only to one directly fitted on a head but also to one for actors or actresses. In the latter application, the wig is attached to a separate, thick matrix (that is formed into a three-dimensional shape, without artificial hairs 30, corresponding to a head of a wearer).

Where the needle 41 is moved perpendicular to the artificial hair 30, the needle 41 may be arranged so as to be movable to left and right.

The automated hair-transplanting apparatus for manufacturing a wig and the method of manufacturing a wig in accordance with the present invention will be useful in manufacturing of a wig.

The invention claimed is:

1. An automated hair-transplanting apparatus for manufacturing a wig comprising:

a conveyor table;

base supplying means for supplying a base onto said conveyor table;

tensioning/positioning means for applying tension to said base which has been supplied onto said conveyor table by said base supplying means so that said base is placed in position in a stretched condition;

artificial hair supplying means for supplying artificial hairs of predetermined length onto one surface of said base which has been supplied onto said conveyor table by said base supplying means and positioned in the stretched condition by said tensioning/positioning means;

a needle movable in a direction perpendicular to the surfaces of said base, said needle piercing said base from the other surface to said one surface and then engaging at said one surface said artificial hair supplied by said artificial hair supplying means and then returning back to said other surface so that said artificial hair is drawn out toward said other surface of said base to be transplanted onto said base;

table driving means for moving said conveyor table in X and Y directions perpendicular to each other with predetermined pitch so that said artificial hair transplanting operation by said needle is repeated with said predetermined pitch;

tension releasing means for releasing said tension given by said tensioning/positioning means to release said stretched condition of said base onto which said artificial hair have been transplanted, after said artificial hair transplanting operation with said needle has been completed; and press means that may be opened and closed to hold said artificial hairs, said artificial hairs being temporarily held by said press means and drawn out by said needle.

2. The automated hair-transplanting apparatus according to claim 1, wherein said press means are swingable toward said needle, drawing-out of said artificial hairs by said needle being initiated after swinging movement of said press means toward said needle.

3. The automated hair-transplanting apparatus according to claim 1, wherein said press means holds said artificial hairs from opposite sides.

4. The automated hair-transplanting apparatus according to claim 1, wherein said press means holds said artificial hairs from up and down.

5. The automated hair-transplanting apparatus according to claim 1, wherein said press means holds said artificial hairs from opposite sides and from up and down.

6. An automated hair-transplanting apparatus for manufacturing a wig comprising:

a conveyor table;

base supplying means for supplying a base onto said conveyor table;

tensioning/positioning means for applying tension to said base which has been supplied onto said conveyor table by said base supplying means so that said base is placed in position in a stretched condition;

artificial hair supplying means for supplying artificial hairs of predetermined length onto one surface of said base which has been supplied onto said conveyor table by said base supplying means and positioned in the stretched condition by said tensioning/positioning means;

a needle movable in a direction perpendicular to the surfaces of said base, said needle piercing said base from the other surface to said one surface and then engaging at said one surface said artificial hair supplied by said artificial hair supplying means and then returning back to said other surface so that said artificial hair is drawn out toward said other surface of said base to be transplanted onto said base;

table driving means for moving said conveyor table in X and Y directions perpendicular to each other with predetermined pitch so that said artificial hair transplanting operation by said needle is repeated with said predetermined pitch;

tension releasing means for releasing said tension given by said tensioning/positioning means to release said stretched condition of said base onto which said artificial hair have been transplanted, after said artificial hair transplanting operation with said needle has been completed; and means for blowing said artificial hairs, transplanted by said needle, toward a predetermined direction, wherein said blowing means comprises a bar arranged below the transplanted artificial hairs and movable in the predetermined direction.

* * * * *